United States Patent [19]

Hamrick et al.

[11] 4,077,469

[45] * Mar. 7, 1978

[54] DOWNHOLE RECOVERY SYSTEM

[75] Inventors: Joseph T. Hamrick, Roanoke; Leslie C. Rose, Rocky Mount, both of Va.

[73] Assignee: World Energy Systems, Fort Worth, Tex.

[ * ] Notice: The portion of the term of this patent subsequent to Sep. 28, 1993, has been disclaimed.

[21] Appl. No.: 727,039

[22] Filed: Sep. 27, 1976

Related U.S. Application Data

[63] Continuation-in-part of Ser. No. 534,778, Dec. 20, 1974, Pat. No. 3,982,591.

[51] Int. Cl.[2] ..... E21B 43/24

[52] U.S. Cl. ..... 166/59; 166/63; 166/65 R; 166/72

[58] Field of Search ..... 166/57, 59, 63, 64, 166/65, 72, 75, 250, 261, 302, 303, 313

[56] References Cited

U.S. PATENT DOCUMENTS

| | | | |
|---|---|---|---|
| 2,506,853 | 5/1950 | Berg et al. | 166/59 |
| 2,887,160 | 5/1959 | DePrlester et al. | 166/59 |
| 2,895,555 | 7/1959 | DePrlester | 166/59 |
| 3,456,721 | 7/1969 | Smith | 166/59 |
| 3,595,316 | 7/1971 | Myrick | 166/250 |
| 3,982,591 | 9/1976 | Hamrick et al. | 166/53 |
| 3,982,592 | 9/1976 | Hamrick et al. | 166/302 |

*Primary Examiner*—James A. Leppink

*Attorney, Agent, or Firm*—Wofford, Felsman, Fails & Zobal

[57] ABSTRACT

A recovery process and system wherein hydrogen and oxygen are introduced into a vented pressure vessel, known as a gas generator, located at the bottom of a borehole, and ignited and burned to produce steam. The hydrogen and oxygen may be introduced either as a stoichiometric mixture or the combustible mixture may be hydrogen-rich. Remotely controlled valves are located downhole near the gas generator for positive control of the hydrogen and oxygen. Provision is made for maintaining the desired hydrogen-oxygen ratio either by a hydrogen flow control slaved to a downhole thermocouple or by a special hydrogen-oxygen flow control employed in the event that ignition is carried out by a DC power supply located downhole. Although the preferred embodiment employs a fuel-oxidizer combination of hydrogen and oxygen, provision is made for employing other fuel-oxidizer combinations.

31 Claims, 21 Drawing Figures

Fig.6
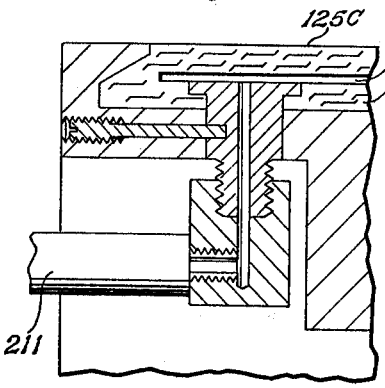
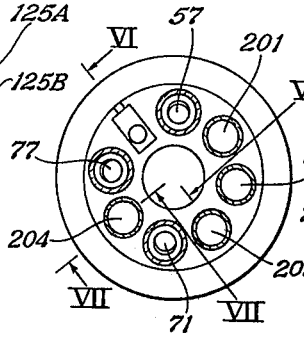
Fig.5
Fig.7
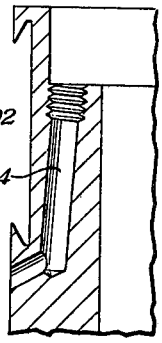
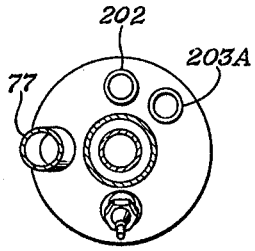
Fig.4
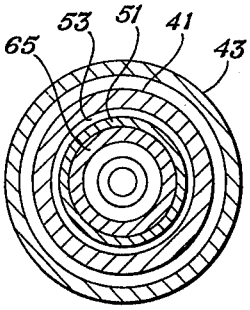
Fig.3
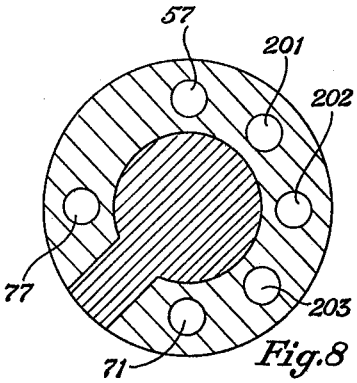
Fig.8
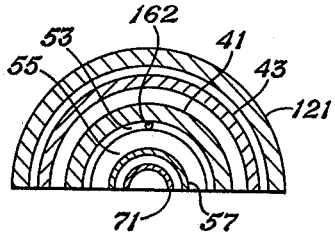
Fig.9
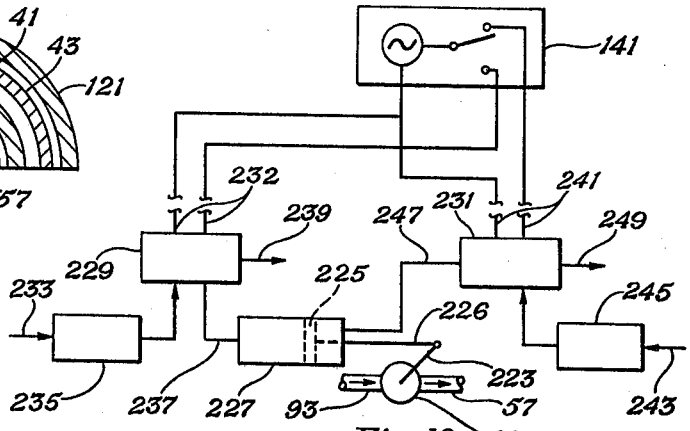
Fig.10

*Fig.11*
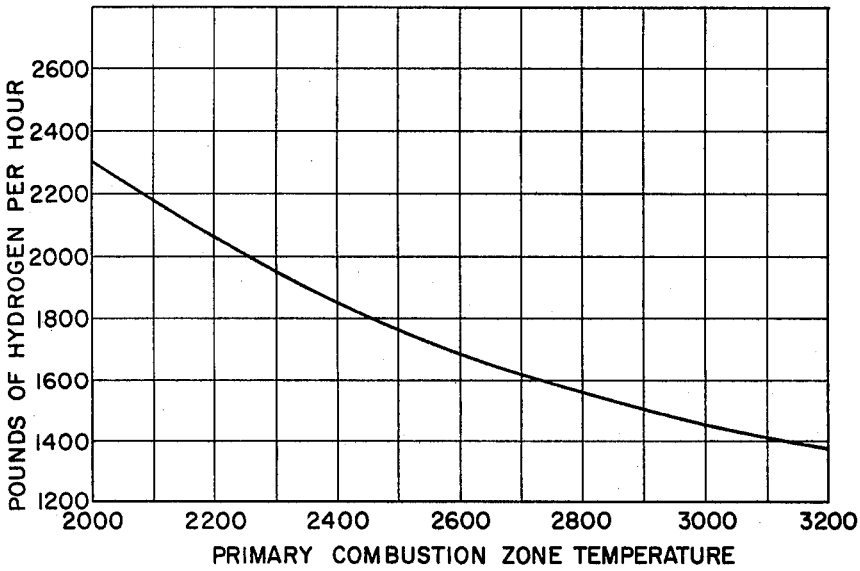
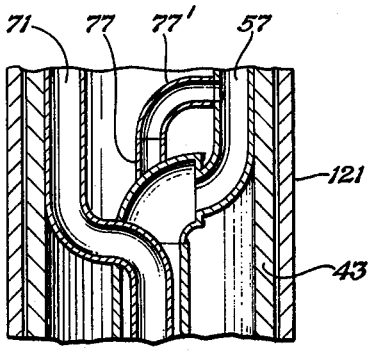
*Fig.12*
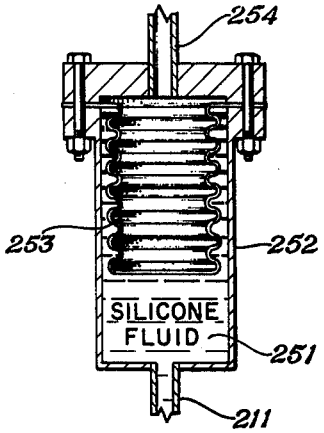
*Fig.13*

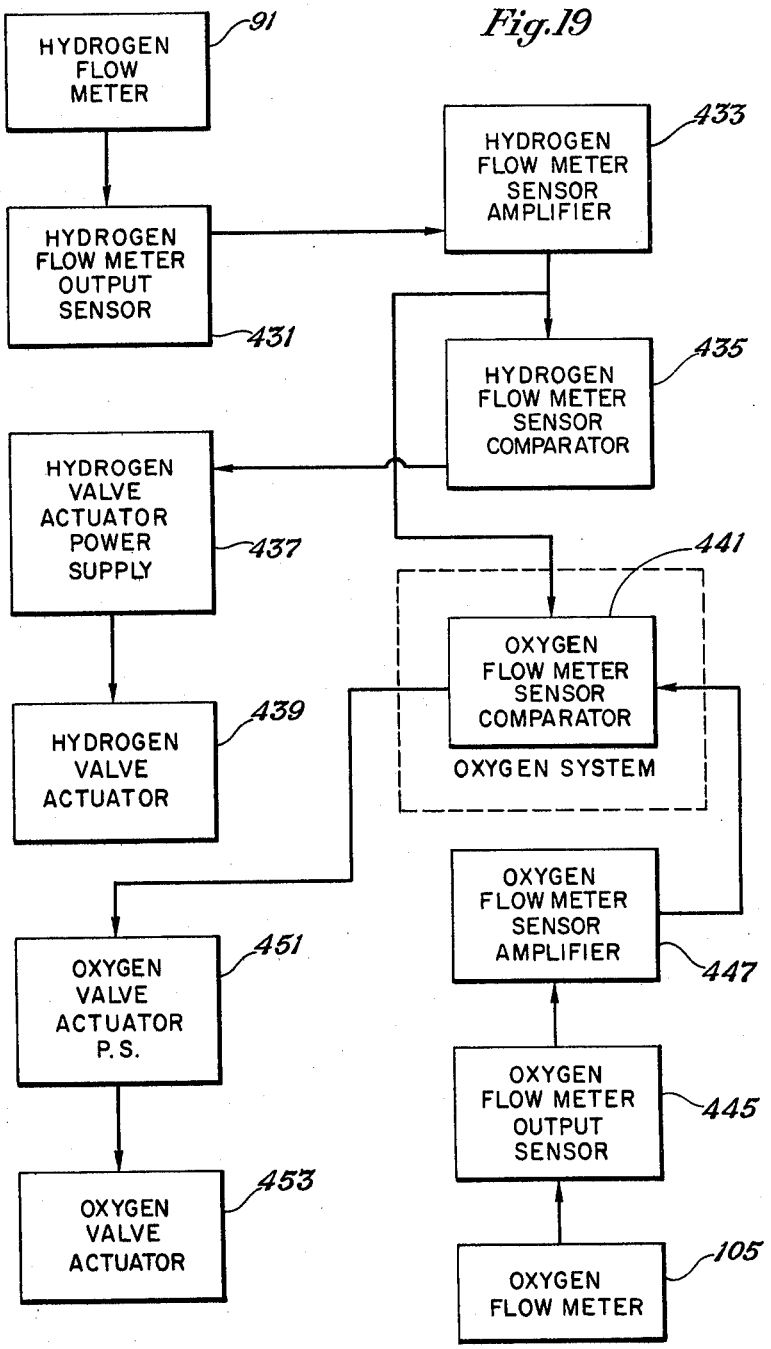
Fig.19
HYDROGEN FLOW METER
91
HYDROGEN FLOW METER OUTPUT SENSOR
431
HYDROGEN FLOW METER SENSOR AMPLIFIER
433
HYDROGEN FLOW METER SENSOR COMPARATOR
435
HYDROGEN VALVE ACTUATOR POWER SUPPLY
437
HYDROGEN VALVE ACTUATOR
439
OXYGEN FLOW METER SENSOR COMPARATOR
441
OXYGEN SYSTEM
OXYGEN VALVE ACTUATOR P.S.
451
OXYGEN VALVE ACTUATOR
453
OXYGEN FLOW METER SENSOR AMPLIFIER
447
OXYGEN FLOW METER OUTPUT SENSOR
445
OXYGEN FLOW METER
105

DOWNHOLE RECOVERY SYSTEM

This application is a continuation-in-part of U.S. patent application, Ser. No. 534,778 filed Dec. 20, 1974 now U.S. Pat. No. 3,982,591.

BACKGROUND OF THE INVENTION

This invention relates to a system and process for recovery wherein steam and other hot gases are produced downhole in a gas generator located at the bottom of a borehole.

For the recovery of highly viscous oil from oil reservoirs, it has been found that hot water and steam piped downhole have been effective in reducing the viscosity of the oil so that it will flow and can be pumped to the surface. One of the problems encountered in piping steam downhole has been associated with heating and expansion of the well bore casing which often results in severe damage to the casing. Another problem arises from loss of heat through the casing from steam enroute to the bottom of the well. Moreover, the known systems cannot pump steam downhole or generate steam downhole at a depth below about 3,500 feet.

It is an object of the present invention to provide a system and process for generating steam and hot gases downhole, for recovery purposes, at a depth down to and below 3,500 feet.

It is another object of the present invention to provide a system and process by which steam and other hot gases may be produced by the combination and burning of a fuel and an oxidizer in a vented pressure vessel, known as a gas generator, located at the bottom of a borehole, thus avoiding the problems caused by heating the well casing and by loss of heat through the casing when hot water and steam are piped downhole. The gas generator comprises a housing forming a chamber which defines a combustion zone. The housing has an upper inlet end for receiving fuel and an oxidizing fluid and a restricted lower outlet for the passage of heated gases. Ignition means is provided for igniting combustible gases in the combustion zone.

It is a further object of the present invention to supply hydrogen and oxygen downhole to the gas generator for the formation of a combustible mixture which is ignited and burned in the combustion zone. The combustible mixture may be a stoichiometric mixture of hydrogen and oxygen or it may be hydrogen-rich. The hydrogen exhausted into the reservoir either by the burning of a hydrogen-rich mixture, contains heat which is transferred to the oil to reduce its viscosity. Because of low molecular weight and high diffusivity, the hydrogen has the added advantage of being able to more readily penetrate the bed containing the oil and can therefore heat a larger bed volume more rapidly than can other gases. In addition, with certain bed compositions which may act as catalysts, the hydrogen can enter into a process normally referred to as hydrogenation to form less viscous hydrocarbons, thus reducing oil viscosity, both by heating and by combining with the oil.

For positive control of the flow of hydrogen and oxygen, remotely controlled valves are provided downhole near the gas generator. These valves are controlled from the surface for controlling the flow of hydrogen and oxygen to the gas generator.

Cooling may be effected by flowing water within an annulus formed within the chamber or by flowing water in the annulus between the gas generator and borehole wall. In the latter embodiment, water also may be injected into the chamber. Other cooling processes are disclosed.

The remotely controlled valves, in one embodiment, are solenoid valves located downhole and controlled from the surface. In another embodiment, a single spool valve having separate valve passages in a valve spool is employed downhole and which is controlled remotely from the surface by a separate solenoid or by the hydrogen pressure. As disclosed other types of remotely controlled valves may be employed.

Hydrogen is supplied from the surface by way of a hydrogen supply, a hydrogen metering valve, and a hydrogen flow meter, all of which are located at the surface. The oxygen is supplied from the surface by way of an oxygen supply, an oxygen metering valve, and an oxygen flow meter which also are located at the surface. In one embodiment, the desired hydrogen-oxygen ratio is maintained by the use of a hydrogen flow control located at the surface and which is slaved to a thermocouple supported by the gas generator. The hydrogen flow control outlet is coupled to the hydorgen metering valve for controlling the desired amount of hydrogen flow therethrough.

In order to reduce the number of conduits and electrical leads extending from the surface through the borehole, to the gas generator, a DC power igniter control may be located downhole to control ignition of the combustible mixture in the gas generator. The igniter control is actuated by a switch supported by the valve spool of the spool valve which is remotely controlled by the hydrogen pressure. In this embodiment, the desired hydrogen-oxygen ratio is maintained by a hydrogen-oxygen flow control coupled to the hydrogen metering valve and hydrogen flow meter and coupled to the oxygen metering valve and oxygen flow meter.

Although the preferred embodiment employs a fuel-oxidizer combination of hydrogen and oxygen, provision is made for employing other fuel-oxidizer combinations.

BRIEF DESCRIPTION OF THE DRAWINGS

FIG. 3 is a cross sectional view of FIG. 2B taken through the lines 3—3 thereof;

FIG. 4 is a cross sectional view of FIG. 2B taken through the lines 4—4 thereof;

FIG. 5 is a cross sectional view of FIG. 2A taken through the lines 5—5 thereof;

FIG. 6 is a cross sectional view of FIG. 5 taken through the lines 6—6 thereof;

FIG. 7 is a cross sectional view of FIG. 5 taken through the lines 7—7 thereof;

FIG. 8 is a cross sectional view of FIG. 2B taken through the lines 8—8 thereof;

FIG. 9 is a cross sectional view of FIG. 2B taken through the lines 9—9 thereof;

FIG. 10 illustrates in block diagram, one of the downhole remotely controlled valves of FIG. 1;

FIG. 11 is a curve useful in understanding the present invention;

FIG. 12 is a modification of a portion of the assembly of FIG. 2B;

FIG. 13 illustrates a modified arrangement for inflating the packer of a modification of the system of FIGS. 1, 2A and 2B;

FIG. 19 is a block diagram of the hydrogen-oxygen flow control system of FIG. 18;

DETAILED DESCRIPTION OF THE INVENTION

Figure 1:
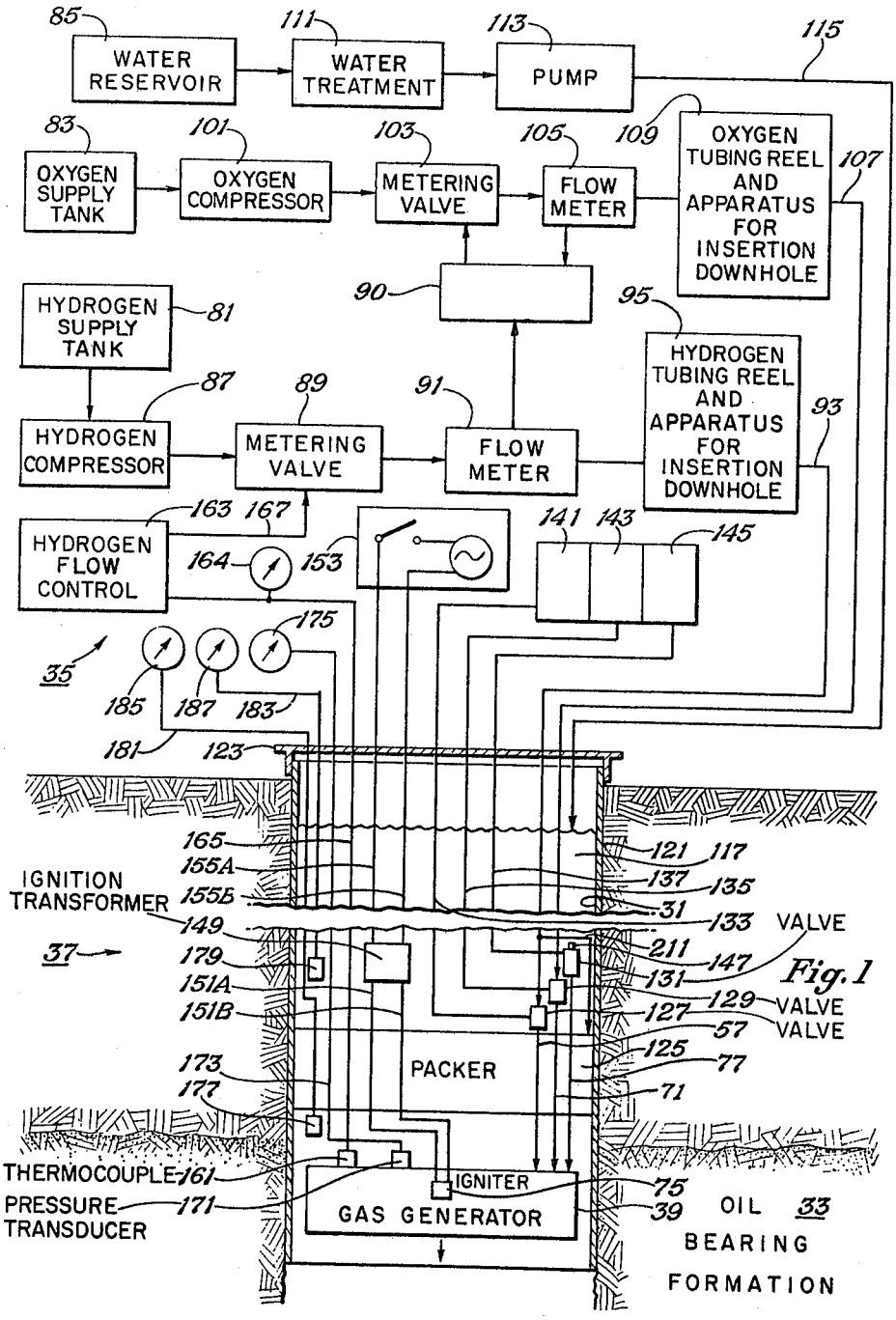
FIG. 1 schematically illustrates one embodiment of the uphole and downhole system of the present invention.

Referring now to FIGS. 1–9, there will be described one embodiment of the recovery system of the present invention which generates steam downhole in a borehole 31 to stimulate production from a subsurface reservoir 33 penetrated by the borehole (see FIG. 1). The steam generated drives the oil in the formation 33 to other spaced boreholes (not shown) which penetrate the formation 33 for recovery purposes in a manner well known to those skilled in the art.

The system of the present invention comprises an uphole system 35 and a downhole system 37 including a gas generator 39 to be located in the borehole at the level of or near the level of the oil bearing formation 33. In the embodiment of FIG. 1, oxygen and hydrogen are supplied from the surface to the gas generator to form a combustible mixture which is ignited and burned in the generator to form steam. The gas generator and steam generated are cooled by water also supplied from the surface.

Figure 2A:
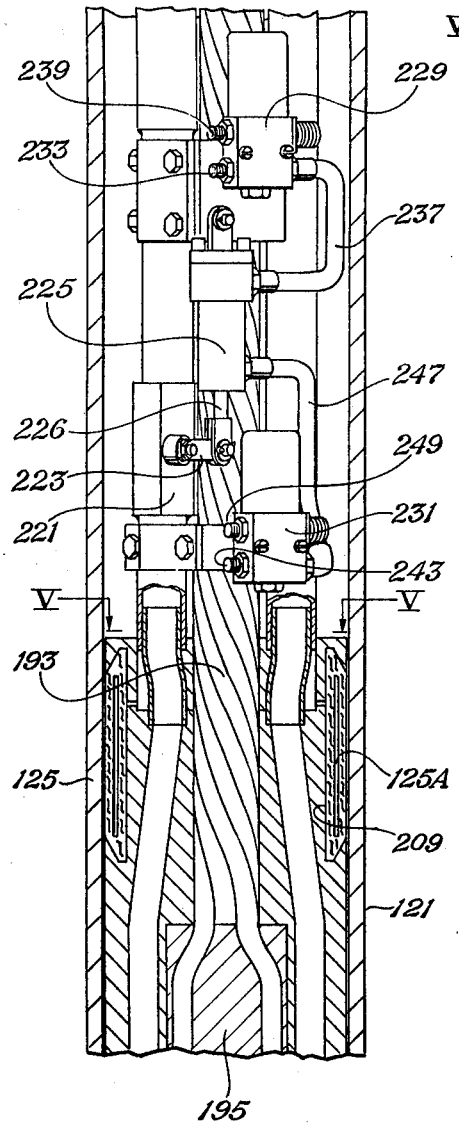
FIG. 2A is an enlarged cross sectional view of the top portion of the downhole housing structure for supporting the gas generator of FIG. 1 in a borehole.
Figure 2B:
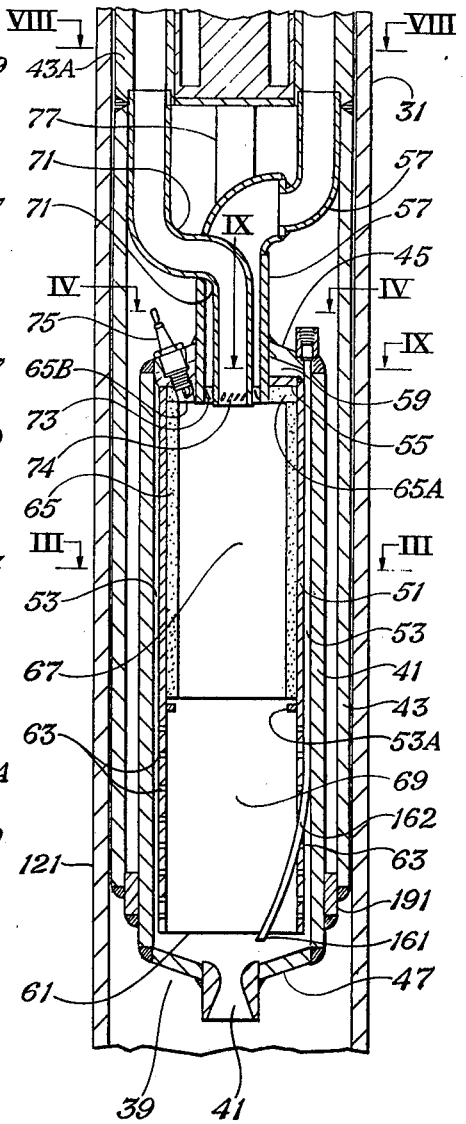
FIG. 2B is an enlarged partial cross sectional view of the lower portion of the housing of FIG. 2A supporting the gas generator of FIG 1. The complete housing, with the gas generator, may be viewed by connecting the lower portion of FIG. 2A to the top portion of FIG. 2B.

Referring to FIGS. 2A and 2B, the gas generator 39 comprises an outer cylindrical shell 41 supported in a housing 43 located in the borehole. The outer shell 41 has an upper end 45 through which supply conduits and other components extend and a lower end 47 through which a small diameter outlet nozzle 49 extends. Supported within the outer shell 41 is an inner shell 51 which forms a cooling annulus 53 between the inner shell and the outer shell. The inner shell has an upper wall 55 which is connected to a conduit 57 which in turn extends through upper wall 45 and is connected thereto. The conduit 57 forms one of the supply conduits, as will be described subsequently and also supports the inner shell 51 within the outer shell, forming the annulus 53 and also forming an upper space 59 between the walls 45 and 55. The space 59 is in communication with the annulus 53, as illustrated in FIG. 9. The opposite end of the inner shell 51 is open at 61. Formed through the inner shell at the lower end thereof is a plurality of apertures 63 which provide passages from the annulus 53 to the interior of the inner shell for the flow of cooling fluid. Supported in the inner shell at its upper end is a heat resistant liner 65 which defines a primary combustion zone 67. The liner is supported by a retention ring 53A and has an upper wall portion 65A through which supply conduits and other components extend. The portion of the interior shell at the level of the apertures 63 is defined as a mixing zone 69.

Conduit 57 extends through walls 45 and 55 and through the upper liner wall 65A to the primary combustion zone 67. Concentrically located within the conduit 57 and spaced inward therefrom is a conduit 71 which also extends to the combustion zone 67. Fuel is supplied through the annulus formed between conduits 57 and 71 while an oxidizing fluid is supplied through conduit 71. Swirl vanes 73 and 74 are provided in the annulus between conduit 57 and conduit 71, and in conduit 71 to mix the oxidizer with the fuel to form a combustible mixture which is ignited in the combustion zone by an igniter 75 and burned. As illustrated, the igniter 75 comprises a spark plug or electrode which extends through walls 45 and 55 and into an aperture 65B formed through the upper liner wall 65A whereby it is in fluid communication with the gases in the combustion zone 67.

In the present embodiment, the oxidizing fluid is oxygen and the fuel is hydrogen whereby steam is formed upon combustion of the hydrogen and oxygen mixture. Cooling fluid is supplied to annulus 53 by way of a conduit 77 (see also FIG. 4) formed through the upper wall 45 of the outer shell 41. In the present embodiment, the cooling fluid is water. From the conduit 77, the water flows to the annulus 53 by way of the space 59 formed between the walls 45 and 55. The water cools the inner shell 51 and flows through apertures 63 to cool the combustion gases to the desired temperature. The steam derived from the combustion of the hydrogen and oxygen and from the cooling water then flows through the outlet nozzle 49 into the formations. Since the exhaust nozzle 49 is small compared with the diameter of the combustion zone, the pressure generated in the gas generator is not affected by the external pressure (pressure of the oil reservoir) until the external pressure approaches approximately 80% of the value of the internal pressure. Therefore, for a set gas generator pressure, there is no need to vary the flow rate of the ingredients into the generator until the external pressure (oil reservoir pressure) approaches approximately 80% of the internal gas pressure.

Referring to FIG. 1, the hydrogen, oxygen, and water are supplied to the generator located downhole by way of a hydrogen supply 81, an oxygen supply 83, and a water supply 85. Hydrogen is supplied by way of a compressor 87 and then through a metering valve 89, a flow meter 91, and through conduit 93 which is inserted downhole by a tubing reel and apparatus 95. Oxygen is supplied downhole by way of a compressor 101, and then through a metering valve 103, a flow meter 105, and through conduit 107 which is inserted downhole by way of a tubing reel and apparatus 109. From the water reservoir 85, the water is supplied to a water treatment system 111 and then pumped by pump 113 through conduit 115 into the borehole 31. In FIG. 1, water in the borehole is identified at 117.

The borehole 31 is cased with a steel casing 121 and has an upper well head 123 through which all of the conduits, leads, and cables extend. Located in the borehole above and near the gas generator is a packer 125 through which the conduits, cables, and leads extend. The flow of hydrogen, oxygen, and water to the generator is controlled by solenoid actuated valves 127, 129, and 131 which are located downhole near the gas generator above the packer. Valves 127, 129, and 131 have leads 133, 135, and 137 which extend to the surface to solenoid controls 141, 143, and 145 for separately controlling the opening and closing of the downhole valves from the surface. The controls 141, 143, and 145 in effect, are switches which may be separately actuated to control the application of electrical energy to the downhole coils of the valves 127, 129, and 131. Valve 127 is coupled to hydrogen conduits 93 and 57 while valve 129 is coupled to oxygen conduits 107 and 71. Valve 131 is coupled to water conduit 77 and has an inlet 147 for allowing the water in the casing to flow to the gas generator when the valve 131 is opened.

The igniter 75 is coupled to a downhole transformer 149 by way of leads 151A and 151B. The transformer is coupled to an uphole ignition control 153 by way of leads 155A and 155B. The uphole ignition control 153 comprises a switch for controlling the application of electrical energy to the downhole transformer 149 and hence to the igniter 75. A thermocouple 161 is supported by the gas generator and is electrically coupled to an uphole hydrogen flow control 163 by way of leads illustrated at 165. The hydrogen flow control senses the temperature detected by the thermocouple and produces an output which is applied to the metering valve 89 for controlling the flow of hydrogen to obtain the desired hydrogen-oxygen ratio. The output from the flow control 163 may be an electrical output or a pneumatic or hydraulic output and is applied to the valve 89 by way of a lead or conduit illustrated at 167.

Also supported by the gas generator is a pressure transducer 171 located in the space between the gas generator and packer for sensing the pressure in the generator. Leads illustrated at 173 extend from the transducer 171 to the surface where they are coupled to a meter 175, for monitoring purposes. Also provided below and above the packer are pressure transducers 177 and 179 which have leads 181 and 183 extending to the surface to meters 185 and 187 for monitoring the pressure differential across the packer.

Referring again to FIGS. 2A and 2B, the gas generator 29 is secured to the housing 43 by way of an annular member 191. The housing in turn is supported in the borehole by a cable 193. As illustrated, cable 193 has its lower end secured to a zinc lock 195 which is secured in the upper portion 43A of the housing. As illustrated in FIGS. 4, 5, and 8, the upper portion of the housing has conduits 77, 57, 201–203, 71 and 204 extending therethrough for the water, hydrogen, igniter wires, thermocouple wires, pressure lines, oxygen, and a dump conduit, the latter of which will be described subsequently. The upper portion of the housing also has an annular slot 209 formed in its periphery in which is supported the packer 125. The packer is an elastic member that may be expanded by the injection of gas into an inner annulus 125A formed between the inner and outer portions 125B and 125C of the packer. (See also FIG. 6.) In the present embodiment, hydrogen from the hydrogen conduit is employed to inflate the packer to form a seal between the housing 43A and the casing 121 of the borehole. Hydrogen is preferred over oxygen since it is nonoxidizing and hence will not adversely affect the packer. Hydrogen from the hydrogen conduit 57 is injected into the annulus 125A by way of a conduit 211 which is coupled to the hydrogen conduit 93 above the downhole valve 127. See FIGS. 1 and 6.

With the downhole system in place in the borehole, as illustrated in FIG. 1, and all downhole valves closed, the start-up sequence is as follows. Hydrogen and oxygen are admitted to the downhole piping and brought up to pressure by opening metering valves 89 and 103. The hydrogen inflates the packer 125 and forms a seal between the housing 43A and the borehole casing 121, upon being admitted to the downhole pipe 93. Water, then is admitted to the well casing and the casing filled or partially filled. This is accomplished by actuating pump 113. Water further pressurizes the downhole packer seal. The ignition control 153 and the oxygen, hydrogen and water solenoid valves 127, 129, and 131 are set to actuate, in the proper sequence, as follows. The igniter is started by actuating control 153; the oxygen valve 129 is opened by actuating control 143 to give a slight oxygen lead; the hydrogen valve 127 is then opened, followed by the opening of the water valve 131. Valves 127 and 131 are opened by actuating controls 141 and 145 respectively. This sequence may be carried out by manually controlling controls 141, 143, 145 and 153 or by automatically controlling these controls by an automatic uphole control system. At this point, a characteristic signal from the downhole pressure transducer 171 will show on meter 175 whether or not a normal start was obtained and the thermocouple will show by meter 164, connected to leads 165, whether or not the desired steam temperature is being maintained. The hydrogen flow controller 163 is slaved to thermocouple 161 which automatically controls the hydrogen flow. The hydrogen to oxygen ratio may be controlled by physically coupling the hydrogen and oxygen valves, electrically coupling the valves with a self synchronizing motor or by feeding the output from flow meters 105 and 91 into a comparator 90 which will provide an electrical output for moving the oxygen metering valve in a direction that will keep the hydrogen-oxygen ratio constant. The comparator may be in the form of a computer which takes the digital count from each flow meter, computes the required movement of oxygen metering valve and feeds the required electrical, pneumatic, or hydraulic power to the valve controller to accomplish it. Such controls are available commercially. The lower the gas generator temperature, the greater the flow of hydrogen required. The flow rate through the metering valve 89 is controlled by electrical communication through conduit 167 from the hydrogen flow controller 163. Communication from the hyrogen flow controller 163 to metering valve 89 optionally may be by pneumatic or hydraulic means through an appropriate conduit. At this point, the flow quantities of hydrogen, oxygen, and water are checked to ascertain proper ratios of hydrogen and oxygen, as well as flow quantities of hydrogen, oxygen, and water. Monitoring of the flow of hydrogen and oxygen is carried out by observing flow meters 91 and 105. The flow rate meters or sensors 91 annd 105 in the hydrogen and oxygen supply lines at the surface also may be employed to detect pressure changes in the gas generator. For example, if the gas generator should flame out, the flow rates of fuel and oxidizer will increase, giving an indication of malfunction. If the reservoir pressure should equal the internal gas generator pressure, the flow rates of the fuel and oxidizer would drop, signaling a need for a pressure increase from the supply. Adjustment of the flow quantities of hydrogen and oxygen can be made by adjusting the supply pressure. Both valves 89 and 103 may be adjusted manually to the desired initial set value.

At this point, the gas generator is on stream. As the pressure below the packer builds up, there may be a tendency for the packer to be pushed upward and hot gases to leak upward into the well casing both of which are undesirable and potentially damaging. This is prevented, however, by the column of water maintained in the casing and which is maintained at a pressure that will equal or exceed the pressure of the reservoir below the packer. For shallow wells, it may be necessary to maintain pressure by pump 113 in addition to that exerted by the water column. For the deep wells, it may be necesssary to control the height of the water column in the casing. This may be accomplished by inserting the water conduit 115 in the borehole to an intermediate depth with a float operated shut off valve; by measuring the pressures above and below the packer; by measuring the pressure differential across the packer; or by measuring the change in tension on the cable that supports the packer and gas generator as water is added in the column. Flow of water into the casing 121 will be shut off if the measurement obtained becomes too great. Water cut-off would be automatic. In addition, a water actuated switch in the well may be employed to terminate flow after the well is filled to a desired height. The pressure and pressure differential can be sensed by commercially available pressure transducers, such as strain gages, variable reluctance elements or piezoelectric elements, which generate an electrical signal with pressure change. Changes in the cable tension can be sensed by a load cell supporting the cable at the surface. In the embodiment of FIG. 1, pressure above and below the packer is measured by pressure transducers 177 and 179, their outputs of which are monitored by meters 185 and 187 for controlling flow of water into the casing 121. On stream operation of the gas generator may extend over periods of several weeks.

In shut down operations, the following sequence is followed. The downhole oxygen valve 129 is shut off first, followed by shut off of the hydrogen valve 127 and then the water valve 131. The water valve should be allowed to remain open just long enough to cool the generator and eliminate heat soak back after shut down. Shut off of the igniter is accomplished manually or by timer after start-up is achieved.

In one embodiment of the oil recovery system, steam is produced by the downhole generator by employing hydrogen and oxygen in a stoichiometric ratio. The steam may be produced at an output of $20 \times 10^6$ BTU/hr. at 1,000 psi and 600° F at a depth of 5,000 feet. The downhole generator may be employed in a borehole casing having an inside diameter of 6.625 inches. Under these conditions, the total weight of hydrogen required for combustion can be found by calculation to equal 327.6 pounds of hydrogen per hour. A total of eight pounds of oxygen is required for each pound of hydrogen or a total of 2620.8 pounds of oxygen per hour. The maximum temperature produced in burning hydrogen stoichiometrically with oxygen is 5,270° F at atmospheric pressure. As the pressure increases, the maximum temperature also increases as there is less dissociation of water. The amount of cooling water required to cool the hot gases can be shown to equal to 13,579 pounds per hour or 3.77 pounds per second. Hydrogen and oxygen conduits 93 and 107 may be 1.00 inch tubing to 1.25 inch schedule pipe. The well casing can be used for the supply of water. Where the water places excessive stress on the suspension system, the water depth in the casing must be controlled, as indicated above. The column pressure of water at 5,000 feet is 2,175 psi. No pumping pressure is needed at this depth. Instead, a pressure regulator orifice will be employed at the well bottom to reduce the pressure at the gas generator. Water is fed directly from the supply in the well casing to the regulator orifice.

It is necessary for start-up and operation of the gas generator to locate the valves downhole just above the packer to assure an oxygen lead at start-up and positive response to control. Use of the downhole remotely controlled valves 127, 129, and 131 has advantages in that they provide positive control at the gas generator for the flow of fluids to the generator. The downhole remotely controlled water valve 131 has advantages in that it prevents premature flooding of the gas generator. The downhole valves 127, 129, and 131 may be cylinder actuated ball type valves which may be operated pneumatically or hydraulically (hydraulically in the embodiment of FIG. 1), using solenoid valves to admit pressure to the actuating cylinder. Where the well casing is used as one of the conduits for water or fuel (to be described subsequently), it will be necessary to exhaust one port of the solenoid valves below the downhole packer. Further, for more positive actuation, it may be desirable to use unregulated water pressure as the actuating fluid, as it will provide the greatest pressure differential across the packer. A schematic diagram of the valve arrangement for each of the valves 127, 129, and 131 is illustrated in FIG. 10. In this figure, the valve is identified as valve 127. The valves 129 and 131 will be constructed in a similar manner. As illustrated, the valve shown in FIG. 10 comprises a ball valve 221 for controlling the flow of fluid through conduit 57. The opening and closing of the ball valve is controlled by a lever 223 which in turn is controlled by a piston 225 and rod 226 of a valve actuating cylinder 227. Two three-way solenoid valves 229 and 231 are employed for actuating the cylinder 227 to open and close the ball valve 221. As illustrated, the three-way solenoid valve 229 has electrical leads 232 extending to the surface and which form a part of leads 133. It has a water inlet conduit 233 with a filter and screen 235; an outlet conduit 237 coupled to one side of the cylinder 227; and an exhaust port 239. Similarly, the valve 231 has electrical leads 241 extending to the surface and which also form a part of leads 133. Valve 231 has a water inlet conduit 243 with a filter and screen 245 coupled therein; an outlet conduit 247 coupled to the other side of the cylinder 227; and an exhaust port 249. Both of ports 239 and 249 are connected to the dump cavity 204 which extends through the upper housing portion 43A from a position above the packer to a position below the packer. Hence, both ports 239 and 249 are vented to the pressure below the packer 125. In operation, valve 229 is energized and valve 231 de-energized to open ball valve 221. In order to close ball valve 221, valve 229 is de-energized and valve 231 energized. When solenoid valve 229 is energized and hence opened, water pressure is applied to one side of the cylinder 227 by way of conduit 233, valve 229, and conduit 237 to move its piston 225 and hence lever 223 to a position to open the ball valve 221 to allow fluid flow through conduit 57. When valve 231 is de-energized and hence closed, the opposite side of the cylinder 227 is vented to the pressure below the packer by way of conduit 247, valve 231 and conduit 249. When valve 231 is opened, water pressure is applied to the other side of the cylinder by way of conduit 243, valve 231 and conduit 247 to move the actuating lever 223 in a direction to close the valve 221. When valve 231 is closed, the opposite side of the cylinder is vented to the pressure below the packer by way of conduit 237, valve 229, and conduit 239.

Referring again to the packer 125, initial sealing is effected by pneumatic pressure on the seal from the hydrogen pressure and finally from pressure exerted by the water column. Thus, the packer uses pneumatic pressure to insure an initial seal so that the water pressure will build up on the top side of the seal. Once the water column in the casing reaches a height adequate to hold the seal out against the casing, the pneumatic pressure is no longer needed and the hydraulic pressure holding the seal against the casing increases with the water column height. Hence, with water exerting pressure on the pneumatic seal in addition to the sealing pressure from the hydrogen, there will be little or no leakage past the packer. More important, however, is the fact that no hot gases will be leaking upward across the packer since the down side is exposed to the lesser of two opposing pressures. In addition to maintaining a positive pressure gradient across the packer, the water also acts as a coolant for the packer seal and components above the packer. The seal may be made of viton rubber or neoprene. The cable suspension system acts to support the gas generator and packer from the water column load. In one embodiment, the cable may be made of plow steel rope.

In one embodiment, the outer shell 41 (FIG. 2B) and the inner shell 51 of the gas generator may be formed of 304 stainless steel. The wall of the outer shell 41 may be $\frac{3}{8}$ of an inch thick while the wall of the inner shell 51 may be $\frac{1}{8}$ of an inch thick. The liner 65 may be formed of graphite with a wall thickness of 5/16 of an inch. It extends along the upper 55% of the inner shell. As the inner shell 51 is kept cool by the water, it will not expand greatly. The graphite also will be cooled on the outer surface and therefore will not reach maximum temperature. The guide vanes 74 in the oxygen tube 71 swirl the incoming oxygen in one direction and guide vanes 73 in the hydrogen annulus between tubes 71 and 57 swirl the hydrogen in a direction opposite that of the oxygen. The oxygen, being heavier than the hydrogen, is centrifuged outward, mixing with the hydrogen. A spark is provided for igniting the hydrogen by means of the electrode 75, as mentioned above. The thermocouple 161 is housed in a sheath of tubing 162 running from the top of the generator to a point near the exhaust nozzle 49 and senses the temperature at that point. This temperature measurement is used to control the fuel-oxidizer flow to the gas generator to maintain an exhaust temperature of 600° F. The leads of the thermocouple extend through conduit 202 of the housing (FIG. 8) and at 165 (FIG. 1) to the surface. The pressure transducer 171 (FIG. 1) allows monitoring of the generator pressure. It is located in the space between the generator and packer and is connected to the generator at 203A (FIG. 4). The transducer 171 has leads 173 extending through conduit 203 of the housing to the surface. The diameter of the oxygen inlet tube 71 is sized to produce a weight flow of 2,621 pounds of oxygen per hour at 1,000 psig and 34.6 feet per second. The hydrogen inlet annulus between tubes 71 and 57 is sized to provide 328 pounds of hydrogen per hour at 1,000 psig and 34.6 feet per second. As the two gases swirl into the combustion zone, their average designed precombustion velocity in the through flow direction is 9.8 feet per second to allow for stable combustion. Upon completion of combustion and cooling of the combustion gases to 600° F, the velocity is 32 feet per second. As the stream derived from combustion of hydrogen and oxygen and from the cooling water moves into the outlet nozzle, it reaches a velocity of 1,630 feet per second for a total weight flow of 4.6 pounds per second. The area of the exhaust nozzle for a nozzle coefficient of 100% is 0.332 inches square. For a nozzle coefficient of 0.96, the area is 0.346 inches square for a diameter of 0.664 of an inch. The inside diameter of the outer shell 41 may be 4.3 inches, and the inside diameter of the inner shell 3.65 inches. For these dimensions, the nozzle 49 may have a minimum inside diameter of 0.664 of an inch. The flow quantity from the gas generator is not affected by oil reservoir pressure until the reservoir reaches the critical pressure of approximately 550 psi. It is not greatly affected until reservoir pressure reaches 800 psi, after which flow rate drops off rapidly. With the high pressures that are associated with a gas generator, a plug can be inserted in the nozzle 49 before the generator is lowered into the borehole, so that it can be blown out upon start-up of the gas generator. The plug will be employed to prevent borehole liquid from entering the generator when it is lowered in place in the borehole. Further, because of the continued availability of high pressure and small area required, a check valve downstream of the nozzle can be provided so that upon shut down of the gas generator, the check valve will close, keeping out any fluids which could otherwise flow back into the generator.

Although not shown, it is to be understood that suitable cable reeling and insertion apparatus will be employed for lowering the gas generator into the borehole by way of cable 193. In addition, if the water conduit 115 is to be inserted into the borehole to significant depths, suitable water tubing reel and apparatus similar to that indentified at 95 and 109 will be employed for inserting the water tubing downhole.

The hydrogen and oxygen metering valves 89 and 103 will have controls for manually presetting the valve openings for a given hydrogen-oxygen ratio. Valve 103 is slaved to valve 89, as indicated above. The valve openings may be changed automatically for changing the flow rates therethrough by the use of hydraulic or pneumatic pressure or by the use of electrical energy. If the metering valves are of the type which are actuated by hydraulic or pneumatic pressure, they may include a spring loaded piston controlled by the hydraulic or pneumatic pressure for moving a needle in or out of an orifice. If the metering valves are of the type which are actuated electrically, they may include an electric motor for controlling the opening therethrough. Suitable metering valves 89 and 103 may be purchased commercially from companies such as Allied Control Co., Inc. of New York, N.Y., Republic Mfg. Co. of Cleveland, Ohio, Skinner Uniflow Valve Div. of Cranford, New Jersey, etc.

In the embodiment of FIG. 1, valve 89 is actuated automatically by thermocouple signal. The downhole thermocouple 161 produces an electrical signal representative of temperature and which is applied to the hydrogen flow control 163. If the metering valve 89 is electrically activated, the hydrogen flow control produces an appropriate electrical output, in response to the thermocouple signal, and which is applied to the valve by way of leads 167 for reducing or increasing the flow rate therethrough. For example, if the thermocouple senses a low temperature, the hydrogen flow control 163 will cause the metering valve 89 and hence valve 103 to increase their openings to increase the flow rate therethrough to provide more heat downhole. If the valve 89 is hydraulically or pneumatically actuated, the hydrogen flow control 163 will convert the thermocouple signal to hydraulic or pneumatic pressure for application to the valve 89 for control purposes.

The flow meters 91 and 105 may be of the type having rotatable vanes driven by the flow of fluid therethrough. The flow rate may be determined by measuring the speed of the vanes by the use of a magnetic pickup which detects the vanes upon rotation past the pickup. The output count of the magnetic pickup is applied to an electronic counter for producing an output representative of flow rate.

In the above embodiment, a stoichiometric mixture of hydrogen and oxygen was disclosed as being introduced and burned in the gas generator to produce steam for reducing the viscosity of the oil by heat and by pressure for secondary recovery purposes. In another embodiment, an excess of hydrogen (hydrogen-rich) may be introduced into the combustion zone of the gas generator for reducing the temperature in the primary combustion zone of the gas generator; for better penetration of the formation bed due to the lower molecular weight of hydrogen; and for hydrogenation of the oil to form less viscous hydrocarbons. Reduction of the temperature in the primary combustion zone with a hydrogen-rich mixture has advantages in that it allows the gas generator to be fabricated out of more conventional materials. In this respect, a low melting point material such as aluminum oxide or silicon dioxide refractory material or even plain stainless steel may be employed as the liner instead of graphite. In order to reduce the temperature in the primary combustion zone to 2,600° F, a flow of approximately 1,675 pounds of hydrogen per hour may be required. This is slightly more than five times the hydrogen flow rate required for stoichiometric burning. The flow rates of hydrogen in pounds of hydrogen per hour required to produce 20 million BTU/hour at primary combustion zone temperatures from 2,000° to 3,200° F as illustrated in FIG. 11 for a constant oxygen flow rate of 2,616 pounds per hour. Because of the low molecular weight and high diffusivity, the hydrogen has the added advantage of being able to more readily penetrate the bed containing the oil and can therefore heat a larger bed volume more rapidly than can other gases. In addition, with certain bed composition which may act as catalysts, the hydrogen can enter into a process normally referred to as hydrogenation to form less viscous hydrocarbons, thus reducing oil viscosity both by heating and by combining with the oil. In the hydrogenation process, the hydrogen will dissociate the crude oil molecules and then combine with the dissociated components to form lighter, less viscous hydrocarbons. In the absence of bed compositions which may act as catalysts, the time required to achieve a substantial amount of hydrogenation may be reduced by injecting a catalyst downhole. For example, the catalyst molybdic acid in solution with ammonium hydroxide can be poured into the well sometime before the heating process is begun, thus allowing the solution to penetrate the bed and move ahead of the pressure front created by the generator exhaust gases.

The system of FIGS. 1–10 can be operated hydrogen-rich by forming the annulus between conduits 71 and 57 to the desired size and by obtaining the desired hydrogen/oxygen ratio by setting the metering valves 89 and 103 and the hydrogen flow control 163 to the proper settings and automatically correcting the hydrogen flow rate through the metering valve 89 by use of the thermocouple 161 and hydrogen flow control 163, as described previously. In addition, correction may be done manually if desired, by monitoring the flow meters 91 and 105 and the thermocouple output meter 164.

In a further embodiment, hydrogen may be used as the coolant of the gas generator rather than water. This has the added advantage in that the water treatment system may be eliminated and only one string of pipe downhole is required. In this embodiment, hydrogen will be introduced through the annulus formed between conduits 71 and 57 for combustion and through the annulus 53 surrounding the combustion zone for cooling purposes. Hydrogen will be supplied through the annulus between conduits 71 and 57 in adequate excess to the primary combustion zone to keep the temperature below 2,000° F. The resulting steam and hot gases will pressurize, heat and reduce the viscosity of the oil, as described previously. The hydrogen flowing through the annulus 53 around the primary combustion zone will further reduce the gas temperature to 600° F. The hot hydrogen from annulus 53 that has been used as a coolant will also penetrate and heat the bed and also enter into the hydrogenation process. Any hydrogen that is pumped downhole and unburned can be recovered at the surface.

The system of FIGS. 1–10 can be modified to allow hydrogen to be used as a coolant by eliminating the water supply system, including the water reservoir 85, water treatment system 111, water pump 113, water conduit 115, and the downhole water valve 131. The well casing itself may be used as the hydrogen supply conduit. In this case, the hydrogen line 93 may extend into the well only a short distance and will not be connected to downhole valve 127. The valve 221 of 127 will be provided an inlet to allow the hydrogen supplied into the borehole to flow through valve 221 of 127 to the conduit 57 when the valve is opened. Hydrogen may be supplied to the annulus 53 by connecting the upper portion of conduit 77 to conduit 57 rather than to valve 131. This may be done by removing the top portion of conduit 77 and connecting an L-shaped conduit 77' to conduit 77 and to conduit 57, as illustrated in FIG. 12. Thus, conduit 77 has one end coupled to conduit 57 by way of L-shaped conduit 77' and its other end in fluid communication with the zone 59 and hence the annulus 53 of the gas generator. In this embodiment, the valve 127 will be employed to control the flow of hydrogen both to the primary combustion zone and to the annulus 53 around the primary combustion zone. Both of the valves 127 and 129 will employ pneumatic pressure from the hydrogen in the borehole for operating their ball valves. In this respect, each of the valves 127 and 129 will allow hydrogen to flow through their inlet and exhaust conduits 233, 243, 239, and 249 for controlling its actuating cylinder 227 (see FIG. 10) for controlling its ball valve 221. As indicated previously, the exhaust ports 239 and 249 will be vented to the lesser pressure below the packer. In operation, the hydrogen pressure in the borehole will be maintained higher than that in the oil reservoir below the packer. Thus, any leakage at the packer is of hydrogen into the oil reservoir.

Referring to FIG. 13, the packer 125 may be inflated with a silicone fluid 251 located in a chamber 252 and which is in fluid communication with the packer annulus 125A by way of conduit 211. The chamber 252 contains a bellows 253 which may be expanded by oxygen supplied through inlet 254, which is coupled to the oxygen conduit 107, to force the silicone fluid 251 into the packer annulus 125A when the oxygen is admitted into the conduit 107.

In the start-up sequence, the igniter 75 will be energized and the oxygen valve 129 will be opened to allow flow of oxygen into the combustion zone followed by the opening of the hydrogen valve 127 to allow the flow of hydrogen into the combustion zone and into the surrounding cooling annulus 53. Upon ignition, the igniter 75 will be automatically shut off by a timer or by hand after ignition is verified by pressure readings. In the shut down sequence, the oxygen valve 129 will be shut off first, followed by the shutting down of the hydrogen valve 127.

In the event that liquid is in the borehole, the hydrogen line 93 may be connected directly to the valve 221 of 127, as described previously, and hydrogen or oxygen pressure (using the embodiment of FIG. 13) may be employed to inflate the packer. In this embodiment, the liquid in the borehole or hydrogen from line 93 may be employed by the valves 229, 231, and cylinder 225 to control the ball valve 221 of each of valves 127 and 129.

Figure 14:
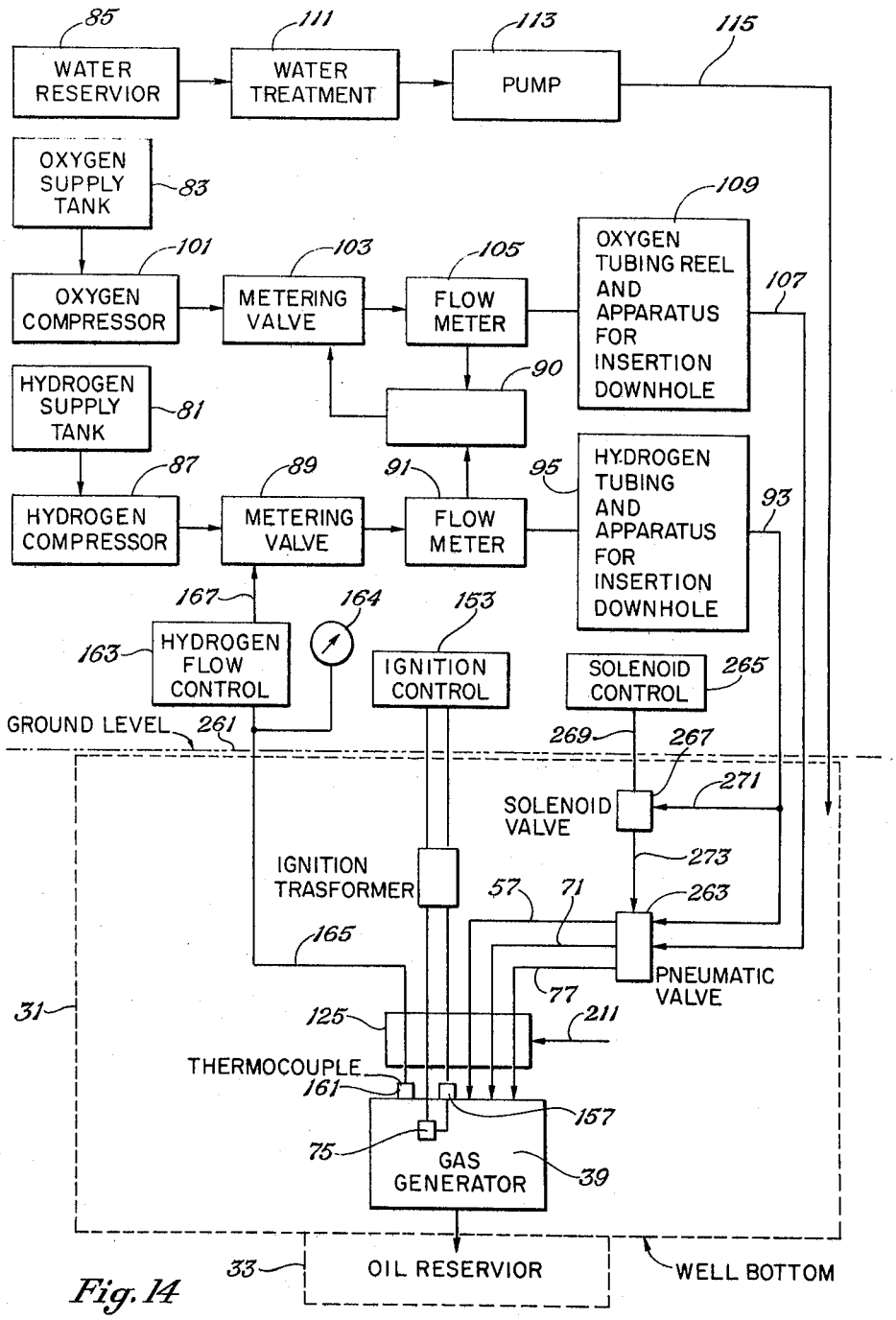
FIG. 14 is another embodiment of the present invention employing a modified downhole remotely controlled valve system.
Figure 15:
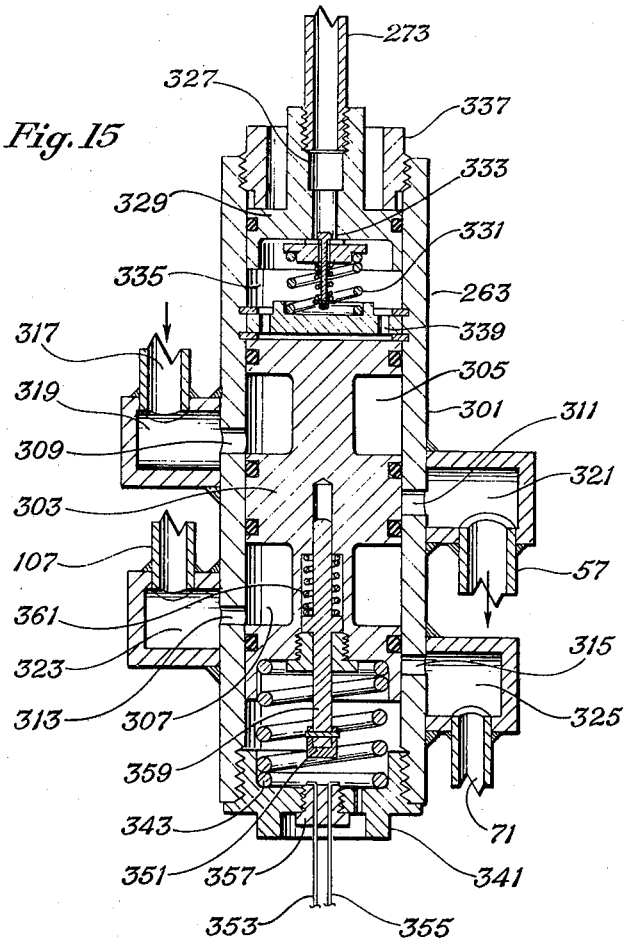
FIG. 15 is an enlarged cross-sectional view of the remotely controlled valve system of FIG. 14.

Referring now to FIGS. 14–17, there will be described another embodiment of the downhole recovery system of the present invention which employs a downhole spool valve for controlling the flow of fuel, oxidizer, and cooling fluid to the gas generator. The spool valve is illustrated in FIG. 15. The uphole and downhole system is similar to that of the embodiments of FIGS. 1–9, however, certain changes are incorporated therein. In FIGS. 14–17, like components have been identified by like reference numerals, as those employed in the embodiment of FIGS. 1–9. In FIG. 14, line 261 indicates ground level. The box identified by reference numeral 31 depicts the cased borehole while reference numeral 33 identifies the oil bearing formation 33. All of the components above line 261 are located at the surface while those below line 261 are located in the borehole. Although not illustrated, the system of FIG. 14 will also employ the igniter 75, a heat switch 157, the transducer 171 and its uphole readout 175 and the transducers 177 and 179 and their uphole readouts 185 and 187. All of these components are not shown in FIG. 14 for purposes of clarity. The spool valve of FIG. 15 is illustrated in FIG. 14 at 263 and is controlled by an uphole solenoid control 265 which is electrically coupled to a downhole solenoid valve 267 by way of electrical leads illustrated at 269. When valve 267 is opened by actuating solenoid control 265, pneumatic pressure (hydrogen) is admitted to the valve 263 by way of branch conduit 271, valve 267, and conduit 273 for controlling the spool valve 263, as will be described subsequently. The system of FIGS. 14–17 employs hydrogen and oxygen which is burned in the combustion zone of the downhole gas generator to produce steam. The hydrogen-oxygen mixture may be a stoichiometric mixture or it may be hydrogenrich, as described previously. The system also can employ hydrogen as the cooling fluid in the surrounding cooling annulus 53, or it may employ water as the cooling fluid. The system of FIGS. 14–17 first will be described as employing hydrogen as the cooling fluid in annulus 53. In this embodiment, the water supply comprising water reservoir 85, water treatment 111, pump 113, and water conduit 115 will not be employed. Although the hydrogen conduit 93 is illustrated as coupled directly to the valve 263, in the first embodiment now to be described, there will be no direct coupling of the conduit 93 to the valve 263. Rather, the conduit 93 will extend into the borehole and the borehole casing will be employed as the conduit for the hydrogen supply. Solenoid valve conduit 271 may be coupled to hydrogen conduit 93 or it may be opened to the borehole for receiving hydrogen for flow to conduit 273 for control purposes when valve 267 is opened. Although not shown, in FIG. 17, the gas generator 39 will have an outer housing which will be supported by a cable in the same manner as described with respect to FIGS. 2A and 2B. The housing also will have an inflatable packer 125 which will be inflated with the silicone fluid forced into the packer by the oxygen from conduit 107, as described with respect to FIG. 13. The spool valve of FIG. 15 will be supported by the cable above the packer.

The hydrogen supply system comprises supply 81, compressor 87, metering valve 89, and flow meter 91 operated in the same manner described previously. Similarly, the oxygen supply system comprises supply 83, compressor 101, metering valve 103, and flow meter 105 operated in a manner similar to that described previously. This is true also with respect to the hydrogen flow control 163 and the ignition control 153.

The starting sequence for the downhole heating system is as follows. The metering valves 89 and 103, which also serve as shut off valves are opened, admitting hydrogen and oxygen to the system which are allowed to stabilize at operating pressure. The ignition control 153 is activated simultaneously with the solenoid valve 267. The solenoid valve 267 admits pressure to the valve 263 which in turn admits hydrogen and oxygen with a slight oxygen lead to the gas generator. The hydrogen and oxygen are ignited and as the temperature rises, the thermocouple 161 senses and controls the temperature by regulating the hydrogen flow through the hydrogen flow control 163. Ignition is shut off manually or by a timer after start up is achieved. In shut down, the oxygen metering valve 103 is shut off first. As the compressed oxygen in the system becomes depleted, the flow of hydrogen can be programmed to automatically drop until the valve 263 shuts off thereby shutting off the gas generator. The system can be operated manually or by automatic controls.

Figure 16:
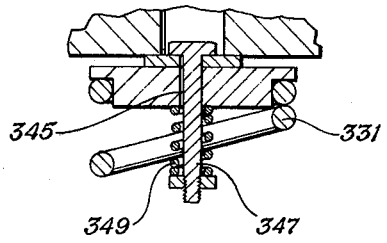
FIG. 16 is an enlarged view of a portion of the valve of FIG. 15.

Operation of the pneumatically operated valve 263 now will be described with reference to FIGS. 15 and 16. The valve comprises a housing 301 having a slidable spool 303 therein with two annular cavities 305 and 307. Cavity 305 is adapted to provide communication between two ports 309 and 311 when the spool is moved downward to a given position. Similarly, cavity 307 is adapted to provide communication between two ports 313 and 315 when the spool is moved downward to the given position. An inlet port 317 is in communication with port 309 by way of cavity 319, while hydrogen conduit 57 is in communication with port 311 by way of cavity 321. In the present embodiment, inlet port 317 will be open to the hydrogen supply to the borehole. Oxygen conduit 107 is in communication with port 313 by way of cavity 323 and oxygen conduit 71 is in communication with port 315 by way of cavity 325. At the top of the valve, branch conduit 273 is threaded into conduit 327 formed in member 329. Operation begins by admitting pressurized fluid (hydrogen) into conduit 273 by opening solenoid valve 267 to allow flow of hydrogen to conduit 273 by way of conduit 271, valve 267 and conduit 273. Solenoid valve 267 is operated by actuating the solenoid control 265 which in effect is a switch which may be closed to supply electrical energy to the valve 267 by way of leads 269. At a pressure predetermined by the setting of spring 331, poppet 333 moves away from its seat on member 329 and pressurized fluid is admitted to chamber 335. The setting of spring 331 is determined by the adjustment of screw fitting 337. Pressurized fluid in chamber 335 is applied through conduits 339 to the top face of valve spool 303 forcing the spool downward inside housing 301. Cavity 305, which is in communication with pressurized hydrogen in cavity 319 by means of port 309, establishes communication with port 311 as the spool moves downward thereby furnishing communication between cavities 319 and 321. Oxygen is supplied to the cavity 323 which establishes communication with cavity 325 by means of port 313, cavity 307, and port 315. In order for cavity 305 to establish communication with port 311, it must travel further than cavity 307 travels to establish communication with port 315. Therefore, oxygen passes through the valve first and will be injected into the generator first thereby providing a slight oxygen lead. As the valve spool 303 moves downward, seating on screw fitting 341, it compresses spring 343 so that when the hydrogen pressure at conduit 327 is reduced to some value during shut down, determined by the spring 343, the valve spool will move upward allowing the valve to shut off the oxygen and hydrogen. When the poppet 333 reseats, any gas trapped in cavity 335 will be released into port 327 through port 345 (illustrated in more detail in FIG. 16) as the residual pressure lifts pintle 347 off of its seat against the spring pressure from spring 349. Spring 349 is provided only to assure seating of pintle 347 when pressure is applied against poppet 333 in the valve opening operation. At the lower end of the valve, a pressure contact switch is provided for automatic downhole battery ignition for a system which will be described subsequently. As the spool 303 moves downward, electrical conducting cap 351 provides electrical communication between conductive leads 353 and 355. Plug 357 and rod 359 are made of dielectric materials, a number of which are available commercially. Spring means 361 assures continued contact between cap 351 and leads 353 and 355, as long as the valve is in the open position. The primary purpose of the spring loaded poppet 333 feature is to assure achievement of hydrogen pressure downhole before the pneumatic valve opens and to assure rapid opening. The cavities 319, 321, 323, and 325 are arcuate in form whereby multiple ports 309, 311, 313, and 315 may be provided at each cavity 319, 321, 323, and 325 respectively.

Figure 17:
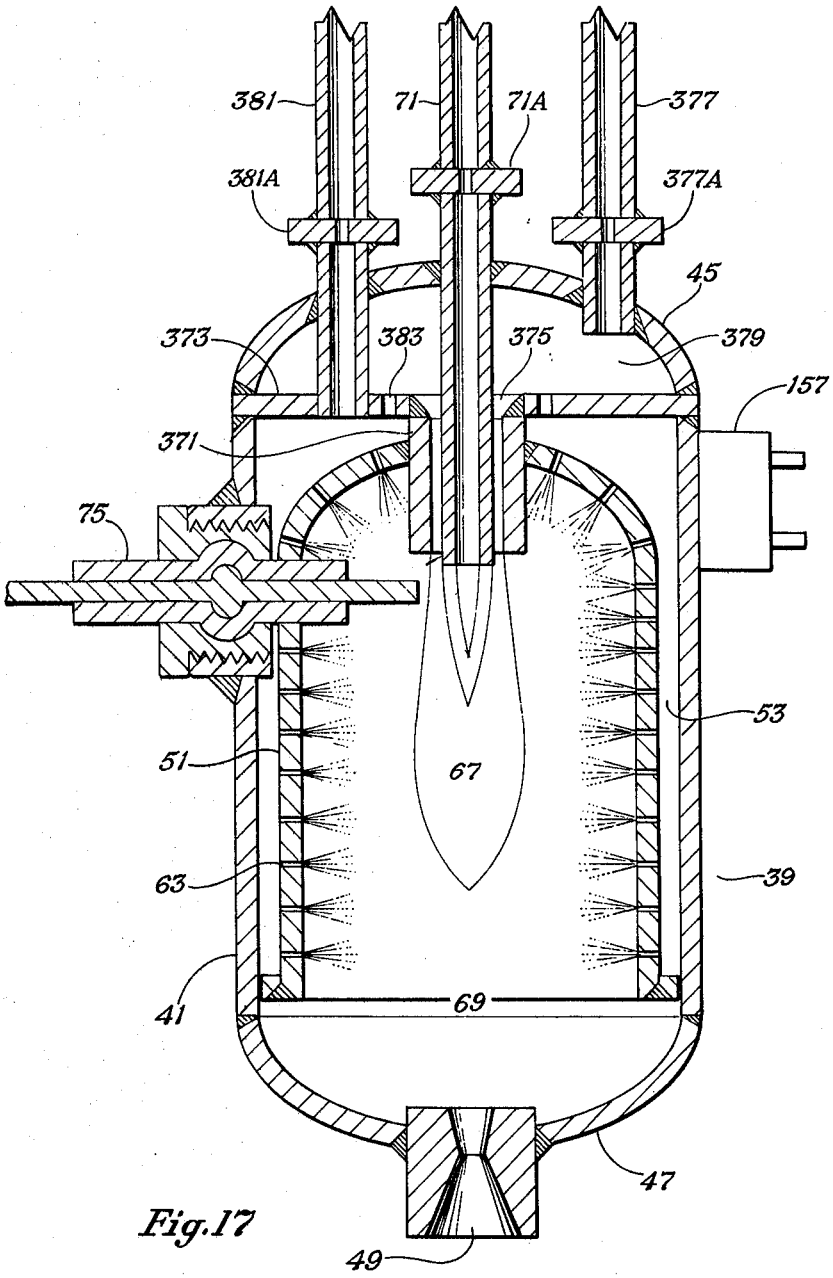
FIG. 17 is an enlarged cross-sectional view of a gas generator similar to that of FIG. 2B but with certain modifications.

Referring to FIG. 17, the gas generator 39 is similar to that shown in FIG. 2B. In this respect, it comprises an outer shell 41 having a lower wall 47 with a small outlet nozzle 49 formed therethrough. Located within the outer shell is an inner shell 51 forming a cooling annulus 53 between the inner shell and outer shell. Formed through the inner shell are a plurality of apertures 63 for the passage of cooling fluid from the annulus 53 to the interior of the chamber. The chamber comprises a primary combustion zone 67 and a mixing zone 69. Also provided is an ignition electrode 75, a heat switch 157 and a pressure transducer and a thermocouple (not shown).

The inner shell 51 is secured to a conduit 371 which extends into the top end of the inner shell and which in turn is secured to an upper plate 373 connected between the top outer wall 45 and the housing 41 of the gas generator. The oxygen conduit 71 extends through wall 45 and into conduit 371 forming a supply annulus 375 between conduit 71 and 371. Also extending through wall 45 is an inlet 377 which is in fluid communication with chamber 379 formed between wall 45 and plate 373. Extending through wall 45 and through plate 373 is another inlet 381 which is in fluid communication with the annulus 53 formed between the inner and outer cylinders 41 and 51. Also formed through plate 73 are a plurality of apertures 383. Although not shown, vanes 74 may be provided at the lower end of conduit 71 and vanes 73 provided in the annulus 375 at its lower end in a manner similar to that shown in FIG. 2B. Oxygen is supplied through conduit 71 while conduits 377 and 381 are connected to the hydrogen conduit 57. In the embodiment of FIG. 17, a refractory lining is not illustrated although such a liner could be located within the inner shell 51, if desired. Such a liner will have apertures corresponding in position with apertures 63. In operation, oxygen enters conduits 71, passes through the orifice in orifice plate 71A and exits into the primary combustion zone 67. Hydrogen enters inlet 377, passes through the orifice in orifice plate 377A and into chamber 379. From chamber 379, part of the hydrogen passes through annulus 375 to the primary combustion zone 67 where it is ignited by an electrically generated spark from ignition electrode 75 to conduits 71 and 371 which are grounded. The remainder of the hydrogen that enters chamber 379 passes through the ports 383 into chamber or annulus 53. Still more hydrogen enters inlet 381, passes through the orifice in orifice plate 381A, and exits into chamber or annulus 53. This arrangement allows external adjustment of the hydrogen flow entering annulus 375 to provide the most efficient mixture in the primary combustion zone 67. The hydrogen in annulus 53 passes through the apertures 63 and enters the mixing zone 69 and the outer fringes of zone 67 to cool the gases produced in the primary combustion zone 67 before they pass out through the exhaust nozzle 49 into the oil reservoir. The thermally operated switch 157 turns the ignition system off when the outer shell reaches a temperature for which the switch is set.

In the embodiment of FIGS. 14–17, if liquid is in the borehole, hydrogen line 93 may be connected directly to inlet line 271 of solenoid valve 267 and to inlet 317 of pneumatic valve 263. Hydrogen or oxygen pressure (using the embodiment of FIG. 13) may be employed to inflate the packer.

The embodiment of FIGS. 14–17 may be modified to allow water to be used as the coolant in cooling annulus 53. In this embodiment, the water reservoir 85, water treatment system 111, pump 113 and water conduit 115 illustrated in FIG. 14 will be employed for supplying water to the borehole as described previously. In addition, the hydrogen conduit 93 will extend and be coupled to the inlet 317 of the spool valve 263 and to inlet 271 of solenoid valve 267. The spool valve of FIG. 15 will be modified to provide a third valve section similar to that of the two shown. In this respect, the housing 301 will have a third inlet/outlet arrangement and the spool 303 will be lengthened and will have a third cavity for allowing communication between the third inlet and outlet combination for the passage of water from the borehole to the water conduit 77 previously described. The third inlet and outlet may be similar to ports 309 and 311 but formed in the housing above ports 309 and 311. The third inlet may have an inlet and cavity similar to 317 and 319 while the third outlet may have a cavity similar to 321 but coupled to inlet 381 of the generator of FIG. 17. The third cavity of the valve spool 303 will be located above cavity 305. The third vavity in spool 303 will be formed to allow water to flow through the valve after the flow of oxygen and hydrogen are allowed to flow therethrough. In this embodiment, plate 373 of the gas generator of FIG. 17 will not have the apertures 383 formed therethrough.

Figure 20:
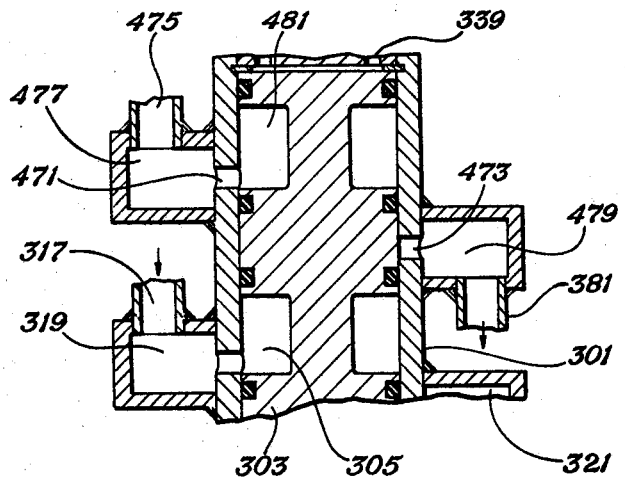
FIG. 20 is a modification of the downhole remotely controlled valve system of FIG. 15.

Referring to FIG. 20, the third inlet and outlet have ports identified at 471 and 473 respectively. An inlet port 475 is in communication with port 471 by way of cavity 477. Port 473 leads to a cavity 479 which is coupled to inlet 381 of the generator of FIG. 17. The spool 303 has a third cavity 481 for allowing communication between the third inlet and outlet combination for passage of water from inlet port 475 to the inlet 381 of the gas generator.

Figure 18:
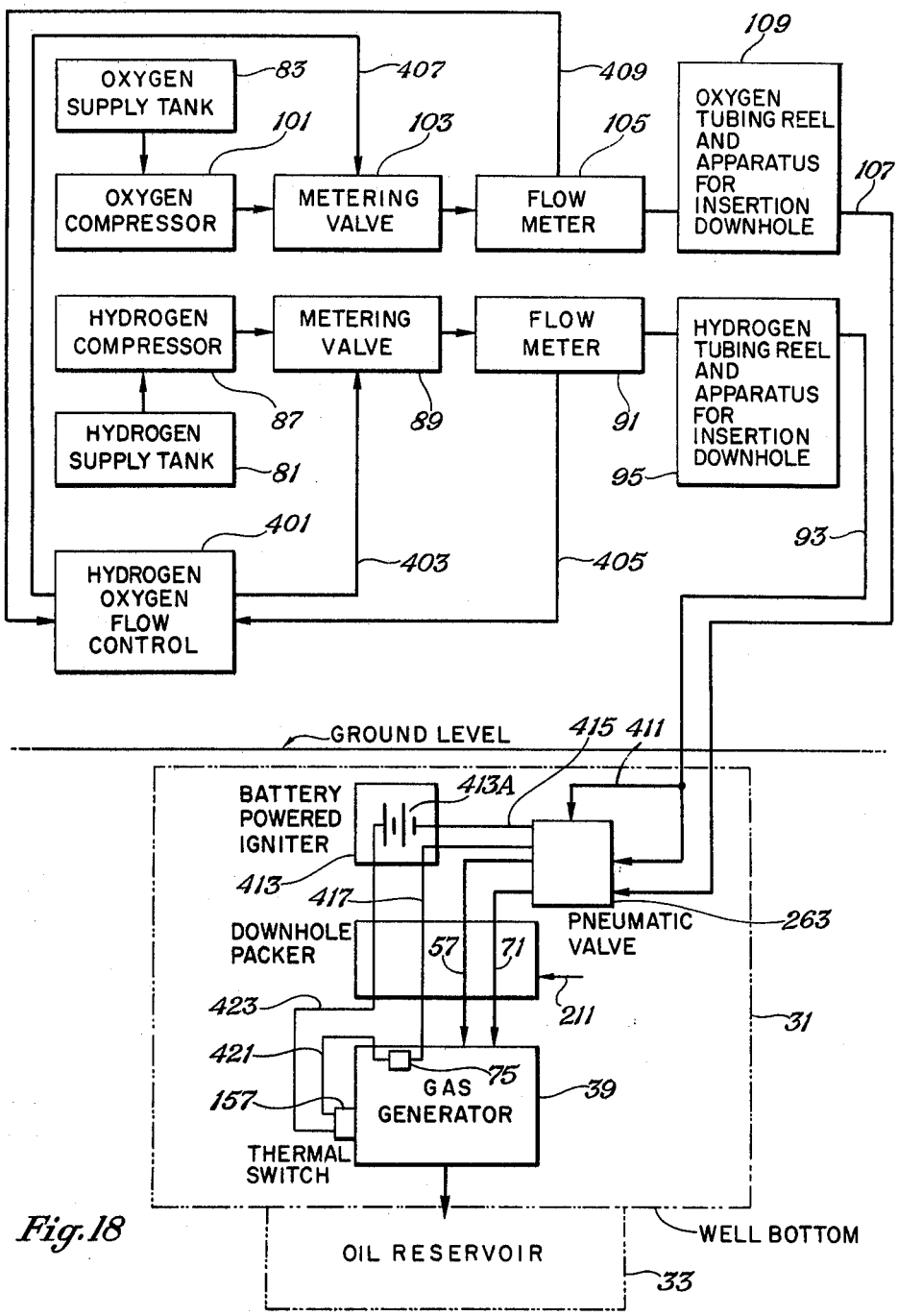
FIG. 18 is a schematic illustration of another embodiment of the present invention.

For deep wells, it may be desirable to eliminate as many of the conduits and electrical leads extending from the surface to the downhole components, as possible. One arrangement for accomplishing this purpose is illustrated in FIG. 18 and which employs an uphole hydrogen-oxygen ratio control and a downhole battery for ignition purposes. High density batteries such as the silve-zinc are commercially available for this application. The system of FIG. 18 burns a hydrogen-oxygen mixture in the combustion chamber of the gas generator and also employs hydrogen in the cooling annulus 53 for cooling purposes. The uphole hydrogen and oxygen supply system is similar to that described previously. The downhole generator employed may be that illustrated in FIG. 17 while the downhole control valve may be that illustrated in FIG. 15. In this embodiment, the oxygen conduit 107 is coupled to the oxygen cavity 323 while the hydrogen conduit 93 extends into the borehole for supplying hydrogen into the borehole and hence downhole by way of the borehole casing. The hydrogen conduit 93 is not coupled to the hydrogen cavity 319 or to conduit 327 of the valve, however, the inlet 317 is open to the borehole for allowing hydrogen from the borehole to pass into the cavity 319 as described previously. Conduit 327 is coupled to conduit 411 which may be open to the borehole. Inflation of the packer is carried out by the arrangement described with respect to FIG. 13. Also provided in the system of FIG. 18 is a hydrogen oxygen flow control 401, the output of which is applied to the metering valve 89 by way of conduit or lead 403 for controlling the metering valve 89 in accordance with the hydrogen oxygen flow rate desired to maintain the desired downhole gas generator outlet gas temperature. The hydrogen flow meter 91 is in communication with the hydrogen-oxygen flow control 401 by way of conduit or leads 405. The hydrogen oxygen flow control 401 also controls the oxygen metering valve 103 by way of conduit or electrical leads 407. In addition, the oxygen flow meter 105 is in communication with the hydrogen oxygen flow control 401 by way of conduit or electrical leads 409. In operation, the metering valves 89 and 103 are opened to allow flow of hydrogen through conduits 93 and 107. Downhole, hydrogen from the casing is applied to the conduit 327 of valve 263 by way of branch conduit 411 to move its valve spool downward to allow the flow of oxygen and hydrogen through the valve 263 with a slight oxygen lead, as described previously. The valve 263 will open at a pressure predetermined by the setting of the spring 331, as described previously. A downhole battery powered igniter 413 comprises a battery 413A having one side, connected, by way of lead 415, to the lead 353 (see FIG. 15) of the valve 263. The other lead 355 of the valve 263 is electrically connected to the ground side of the electrode 75 by way of lead 417. The electrode 75 also is electrically connected to the heat switch 157 by way of lead 421 which in turn is connected to the other side of the battery by way of lead 423. When the spool of valve 263 is moved downward by the hydrogen applied to conduit 327 to connect contact 351 between leads 353 and 355, electrical energy is supplied to the electrode for igniting the combustible mixture in the gas generator.

Start-up is accomplished as follows. The oxygen metering valve 103 is opened to the predetermined run position and pressure allowed to stabilize. The hydrogen metering valve 89 then is opened to the predetermined run position. When the hydrogen reaches approximately 90–95% of run pressure, the downhole pneumatic valve 263 opens allowing hydrogen and oxygen to flow to the generator (with a slight oxygen lead) and at the same time turning on the battery powered igniter. When the gas generator shell approaches the stabilization temperature, the thermoswitch 157 disconnects the battery powered igniter. To shut down the generator, the oxygen metering valve 103 is shut off and the system allowed to run down with a preprogrammed flow of hydrogen. The pneumatic valve shuts off as the hydrogen pressure is depleted. This system requires calibration with the downhole components instrumented above ground. In the embodiment of FIG. 18, if liquid is in the borehole, hydrogen line 93 may be connected directly to inlet 317 of pneumatic valve 236 and to branch conduit 411. Hydrogen or oxygen pressure (using the embodiment of FIG. 13) may be employed to inflate the packer.

If the system of FIG. 18 is to be employed with water as a coolant for the annulus 53, then the water supply system previously discussed will also be employed for injecting water into the borehole casing. The hydrogen conduit 93 will be connected to the hydrogen inlet 317 of the valve 263 and to branch conduit 411. The valve 263 will be modified to provide a third cavity and a third inlet and outlet port for the passage of water to the annulus 53 by way of conduit 381, as described previously. In this embodiment, the packer 125 will be inflated by the hydrogen pressure, as described previously with respect to the embodiment of FIGS. 1–9. On start up, valve 103 will be opened, followed by the opening of valve 89 and then the injection of water into the casing. On shut down, the valve 103 will be shut down and after the pneumatic valve automatically shuts off, the metering valve 89 will be shut down followed by shut down of the water pump system.

Referring now to FIG. 19, there will be described in more detail, the operation of the hydrogen-oxygen flow control 401. The signal from the flow meter 91 which varies with flow quantity, is fed through an output sensor 431 and then to a sensor amplifier 433. The signal from amplifier 433 is fed to a sensor comparator 435 which compares the signal with a preset signal. Any difference between the signal generated by the flow meter 91 and the preset signal will be fed to the valve actuator power supply 437 for the metering valve 89 which in turn will move the valve actuator 439 in such a direction as to result in a flow quantity that will cause the output of the flow meter 91 to equal the preset signal. The flow meter may be of the type which generates an electrical pulse for each revolution of a rotating flow element or vane. The count from the electrical pulses can be compared electronically to a set digital count in the comparator. The comparator will effect a varying of the flow rate until the count from the flow meter 91 equals the set digital count. The control by the hydrogen-oxygen flow controller may be by pneumatic or hydraulic means instead of electrical means. The oxygen control portion of the hydrogen-oxygen flow control 401 is the same as that for hydrogen except that instead of providing a preset signal to which the sensor signal is compared, the signal generated by the hydrogen flow meter 91 is fed to an oxygen flow meter sensor comparator 441 and is used as a set signal for the oxygen. The output of the oxygen flow meter 105 is applied to an oxygen flow meter output sensor 445 which may be the same as sensor 431 and whose output is applied to an oxygen flow meter sensor amplifier 447. The output of amplifier 447 is applied to the comparator 441 for comparison with the signal applied from the hydrogen flow meter. The gain of amplifier 447 will be appropriately set. Any difference between the signal outputs from amplifiers 435 and 447 will be fed to the valve actuator power supply 451 of the oxygen metering valve 103 which in turn will move the valve actuator 453 in such a direction as to result in a flow quantity which will cause the output of amplifier 447 to equal the output of amplifier 435. By this arrangement, the oxygen to hydrogen ratio can be maintained constant.

The advantages of the fuel-oxidizer combination of hydrogen and oxygen, whether as a stoichiometric mixture or hydrogen-rich and with water or hydrogen as a coolant has been set forth above. In addition, the ability to produce hydrogen by electrolysis of water makes hydrogen attractive as a fuel. Obviously, oxygen is simultaneously produced in exactly the ratio that is required for stoichiometric burning downhole to produce steam. Further, the hydrogen and oxygen can be produced by electrolysis at the pressures required for use, thus eliminating the requirement of compressors. If water is used for a coolant for hydrogen and oxygen burned stoichiometrically, steam is the only end product. There are no contaminants. If excess hydrogen is used, the flame temperature resulting from the hydrogen-rich oxygen combustion can be tailored to the temperature which conventional metal can withstand, as indicated above. For example, if hydrogen and oxygen are combined in a ratio of 0.8 pounds of hydrogen to 1 pound of oxygen, the combustion temperature will be 2,000° F, a temperature easily withstood by many of the stainless steel alloys. The resulting products can then be cooled to any desired temperature by additional hydrogen or water. With the use of hydrogen only as a coolant, there is no need for water hardness treatment for downhole water, as there is no water used except where hydrolysis is used for hydrogen-oxygen generation. The excess hydrogen, which is the same temperature as the steam that is produced, also serves to heat the reservoir bed. Hydrogen, having an extremely low molecular weight and high diffusivity penetrates the bed more easily and rapidly than any other gas, vapor, or liquid. In the gaseous state, one pound of hydrogen can transfer to the bed, the same amount of heat as 13.5 pounds of steam, although, upon condensing, steam transfers significantly more heat to the bed in the smaller area that it has penetrated. Further, the hot hydrogen that has been used as a coolant, can dissociate the crude oil molecules and then combine with the dissociated components to form lighter weight, less viscous, hydrocarbons, a process known as hydrogenation and which is greatly accelerated by certain catalysts. Moreover, any hydrogen that is pumped downhole and unburned can be recovered at the surface.

Although the use of the fuel-oxidizer-coolant combinations of hydrogen and oxygen or hydrogen, oxygen, and water mentioned above have advantages, it is to be understood that other fuel-oxidizer cooling medium combinations may be used in the present system. These combinations are set forth in Table I, along with the combination of hydrogen and oxygen and of hydrogen, oxygen, and water. Performance of the gas generator with hydrogen, ammonia, or methane as fuel with oxygen as an oxidizer and hydrogen, ammonia, water or methane as a cooling medium also is set forth in Table I. As an alternative, ammonium hydroxide may be used instead of water for the purpose set forth in Table I. Computations are based on 20,000,000 BTU per hour at 1,000 psi and 1,000° F. The 20,000,000 BTU per hour computation is based on a high heat value of hydrogen at 61,045 BTU per pound, methane at 23,910 BTU per pound and ammonia at 6,870 BTU per pound. The fuel-oxidizer-cooling medium combinations listed in lines 3 and 5 in Table I will be employed in the same embodiments as the hydrogen-oxygen-water combination were described as employed and operation of these embodiments with the fluid combinations of lines 3 and 5 of Table I will be the same as described previously with respect to the hydrogen-oxygen-water combinations. In the fluid combination of line 3 of Table I, ammonia may be used directly to inflate the packer while in the fluid combination of line 5 of Table I, methane may be used directly to inflate the packer. The fuel-oxidizer-cooling medium combinations set forth in lines 4 and 6 of Table I, will be used in the same embodiments as the hydrogen-oxygen-hydrogen combination was described as employed, and operation of these embodiments with the fluid combinations of lines 4 and 6 will be the same as described previously with respect to the hydrogen-oxygen-hydrogen combination. In both of the fluid combinations of lines 4 and 6 of Table I, oxygen may be applied to the device of FIG. 13 for inflating the packer.

All products of combustion of ammonia with oxygen are gaseous. Therefore, there is no problem of clogging the bed. Nitrogen is produced, however, and may become a potential contaminant in the bed. Ammonia and ammonium hydroxide are excellent coolants and are very competitive with water. Both result in accumulation of ammonia downhole. However, the ammonia is recoverable at the surface. Both ammonia and ammonium hydroxide are liquid at relatively low pressures and can be stored or transported in tanks in the liquid state at atmospheric temperatures. Thus, handling, storage, and pumping of ammonia or ammonium hydroxide present no significant problems.

Although methane may be used as a fuel, this gas is less contaminant free than hydrogen, as it will break down into carbon and hydrogen at temperatures above 1200° F. Upon combustion with oxygen, it produces $CO_2$ which is a contaminant gas in the reservoir bed. It may perform best, when burned stoichiometrically, with oxygen and the resulting gases cooled with water. Excess methane can be used as a coolant, but there is a risk of clogging the bed with carbon particles from dissociated methane.

TABLE I

| | Fuel-Oxidizer Combination | Cooling Medium | Fuel lbs/hr | Oxygen lbs/hr | Water lbs/hr | Exhaust Gases lbs/hr | | | | | |
|---|---|---|---|---|---|---|---|---|---|---|---|
| | | | | | | $H_2O$ | $N_2$ | $CO_2$ | $H_2$ | $CH_4$ | $NH_3$ |
| (1) | Hydrogen-Oxygen | Water | $H_2$ 327 | 2,616 | 10,630 | 13,573 | | | | | |
| (2) | Hydrogen-Oxygen | Hydrogen | $H_2$ 5,120 | 2,616 | 0 | 2,943 | | | 4,793 | | |
| (3) | Ammonia-Oxygen | Water | $NH_3$ 2,915 | 4,100 | 8,580 | 13,230 | 2,400 | | | | |
| (4) | Ammonia-Oxygen | Ammonia | $NH_3$ 14,420 | 4,100 | 0 | 4,610 | 2,400 | | | | 11,505 |
| (5) | Methane-Oxygen | Water | $CH_4$ 837 | 3,348 | 11,400 | 13,283 | | 2,302 | | | |
| (6) | Methane-Oxygen | Methane | $CH_4$ 21,300 | 3,348 | 0 | 1,883 | | 2,302 | | 20,463 | |

In addition to use of the steam as a steam drive and driving the oil to nearby wells, it is also an object of this invention to use the steam in a steam-soak operation. In this method, steam is usually injected for a few days such as 5 to 15 and then the well is closed in for the soak period for about one week, after which the well is put back on production. This technique is also called "huff and puff" by those skilled in the art and has been practiced on several thousand wells.

The gas generator may be applied to oil shales for insitu retorting. In this application, a hole is drilled or mined into the shale. If the shale is naturally fractured sufficiently then the hot gases from the gas generator may be applied directly to the shale. At temperatures above about 900° F, the oil is released from the shale. The desired fluids may be driven to nearby wells or produced from the same well in either a continuous or cyclic fashion.

For hard, impermeable shale, the shale may be fractured by the use of explosives. Such a fractured matrix will permit the hot vapors to come into contact with the shale in an easier manner.

It is another object of this invention to employ the gas generator to insitu gasification of coal. In this application, a hole is drilled or mined into the coal bed and the hot gases from the gas generator are permitted to contact the coal. The high temperatures of the gases will result in a reaction with the coal resulting in the formation of carbon monoxide and hydrogen. This gas may be burned as a low grade fuel or it may be upgraded, if desired.

In some oil reservoirs, the oil recovery is increased by gas injection or pressure maintenance programs. In these operations, natural gas or flue gas may be used as the gas for injection purposes.

The subject gas generator may be used to supply the flue gases for gas injection purposes. For this operation, the apparatus is located in the well and operated for sustained periods. If air is used as the principal oxidizing media, then the flue gas will consist primarily of nitrogen and water vapor. If a hydrogen rich stream is used, then the excess hydrogen will be available for injection into the oil sand along with nitrogen or water vapor. The hot gases and volatile hydrogen reduce the viscosity of the oil so that it flows more freely into the producing well.

In recovering oil by the insitu combustion recovery process, air or air diluted with flue gas or air and water may be used. After combustion is cause to occur at an injection well then any of the above fluids may be used to sustain the combustion process and push the oil to a nearby oil producing well.

The subject gas generator may be operated in such a manner as to fulfil any of the above functions. The gas generator may be operated with an excess of oxygen or air. In which event the unused oxygen would be injected into the rock matrix and would serve to sustain the combustion zone in the usual manner.

The gas generator may be operated using water as a coolant and excess oxygen or air. In this case, the hot water or steam and excess oxygen would enter the oil sand. The steam or hot water serves to heat the oil sand and the excess oxygen sustains the combustion process within the pores of the rock.

Figure 21:
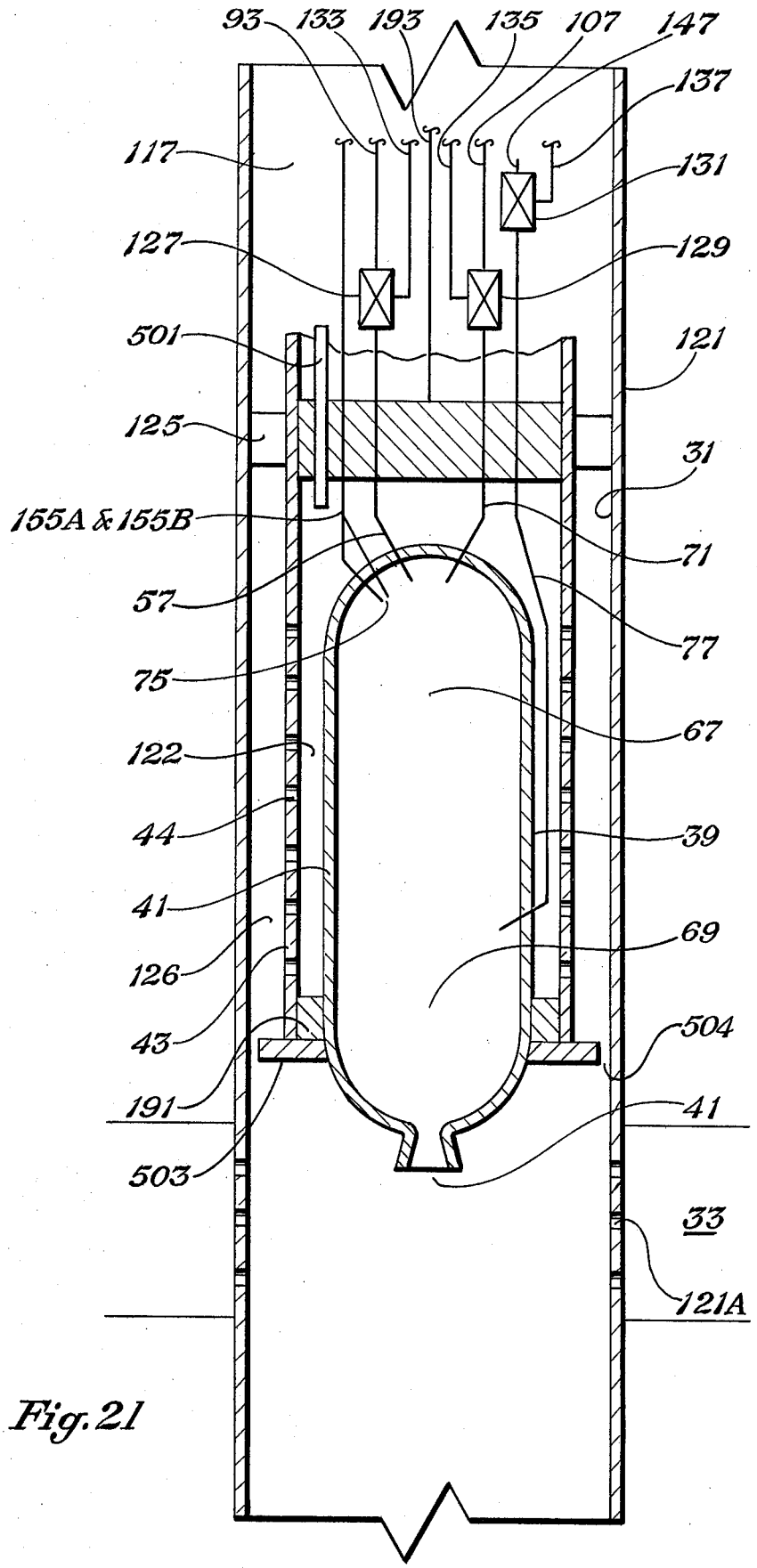
FIG. 21 is a modification of the gas generator wherein the internal cooling chamber may be eliminated.

Referring now to FIG. 21, there will be described a modification of the gas generator of the embodiment of FIGS. 1–10. In FIG. 21 like numbers identify like components of the system of FIGS. 1–10. The downhole thermocouple and transducers are not shown for purposes of clarity. Apertures 121A are formed in the casing 121 for the passage of hot gases into the formation 33. In the modification of FIG. 21, the internal cooling annulus 53 may be eliminated or not employed by flowing water in the borehole above the packer 125, downward through the packer 125 and into the annulus between the housing wall of the gas generator and the wall of the borehole in order to cool the gas generator. In FIG. 21 a conduit 501 is shown employed for this purpose. As described with respect to the conduits of FIG. 5, it will extend through the central portion of the gas generator within the packer 125. It will also have a restricted opening to provide controlled flow of the water through the conduit 501. Although not shown, the lower end of conduit 501 may be connected to a manifold located in the annular space 122 and will surround the gas generator. The manifold may have a plurality of jets around its inner periphery for spraying water onto the gas generator around its outer periphery. From annular space 122 the water will flow through apertures 44, formed in housing 43, into the annular space 126 formed between housing 43 and the casing 121. An annular member 503 is connected to the lower end of the gas generator to provide a restricted lower annular opening 504 between the gas generator and the borehole wall to restrict the flow of water downward to insure that water will fill the upper annular space between the gas generator and the wall of the borehole. Member 503 may be a metal member welded to the lower end of the gas generator. In the chamber of the gas generator, the lower end of the shell 51 may be eliminated, however, the upper end of shell 51 may be retained to support the liner 65. For purposes of clarity, the liner 65 is not shown in FIG. 21. When burning a hydrogen-rich mixture of hydrogen and oxygen, the water valve 131 and conduit 77 may be eliminated whereby water will not be injected into the chamber 69. Cooling may be effected by the lower temperature of combustion and water in the annulus between the wall of the gas generator and the wall of the borehole. Start-up and shut down will be the same as that described above with respect to the embodiment of FIGS. 1–10 wherein water is employed for cooling except in this case water will not be injected into the chamber 69.

When burning a stoichiometric mixture of hydrogen and oxygen, the water valve 131 may be retained and the conduit 77 connected to the lower portion of the gas generator for injecting water into the chamber portion 69. As shown in FIG. 21, conduit 77 extends through the chamber wall 41 into the chamber portion 69. Although not shown, the conduit 77 may be connected to a manifold surrounding the gas generator. The manifold may have a plurality of conduits leading into the chamber 69 of the gas generator whereby water will be injected into the chamber 69 at a plurality of points around its inner periphery. Cooling, thus, is effected by water in the annulus between the gas generator and the borehole wall and by water injected into the chamber of the gas generator. This embodiment also may be used wherein a hydrogen-rich mixture of hydrogen and oxygen are burned in the gas generator. Start-up and shut down will be the same as that described above with respect to the embodiment of FIGS. 1–10 wherein water is employed for cooling.

In the embodiment of FIGS. 1–17 and 21, ignition was described as being affected by a spark plug or electrode 75 energized from a source located at the surface. In order to eliminate the electrical conductors extending from the surface to the gas generator required for actuating electrode 75, a hypergolic combination of fuel and an oxidizer may be employed to effect ignition of the combustible gases in the chamber 67 of the gas generator. Such a process is disclosed and claimed in U.S. patent application Ser. No. 714,787 filed Aug. 16, 1976. As described in application, Ser. No. 714,787, prior to start-up valves 127 and 129 will be closed. A slug of start-up fuel is injected through conduit 93 to closed valve 127. A slug of oxidizing fluid also injected through conduit 107 to closed valve 129. In one embodiment the start-up fuel may be aniline and the oxidizing fluid may be $N_2O_4$ (white fuming nitric acid). Next the hydrogen and oxygen sources will be connected to conduits 93 and 107 respectively to pressurize these conduits with hydrogen and oxygen behind the start-up fuel and oxidizing fluids. Valves 127 and 129 then are opened to allow the slugs of start-up fuel and oxidizing fluid to flow into the combustion chamber 67 for mixture where the start-up fuel will ignite spontaneously and in turn ignite the hydrogen and oxygen which follow through conduits 93 and 107.

Although the downhole valves 127, 129 and 131 were described as solenoid operated valves with their actuating solenoids located downhole, it is to be understood that these valves may be controlled pneumatically or hydraulically by tubing which will communicate the pneumatic or hydraulic means from the surface to the valves. The pneumatic or hydraulic means at the surface may be controlled by solenoid actuated valves located at the surface.

We claim:

1. A system for use for recovering hydrocarbons or other materials from underground formations penetrated by a borehole comprising:

a gas generator locator in the borehole at or near the level of said formations, said gas generator comprising: a housing forming a chamber defining a combustion zone and having an upper inlet end for receiving fuel and an oxidizing fluid for forming a combustible mixture of gases in said combustion zone for ignition, and a restricted lower outlet for passage for heated gases, means, including conduit means extending from the surface, for supplying fuel from the surface to said inlet end of said gas generator located in said borehole, means, including conduit means extending from the surface, for supplying an oxidizing fluid from the surface to said inlet end of said gas generator located in said borehole, and valve means remotely controllable from the surface and located in said borehole near said gas generator for separately controlling the flow of fuel and oxidizing fluid to said gas generator, said valve means when located in said borehole near said gas generator being inaccessible without withdrawing said gas generator from said borehole.

2. The system of claim 1 wherein:

the outer wall of said gas generator is spaced inward from the wall of said borehole defining an annulus for receiving water from said borehole for cooling purposes.

3. The system of claim 2, comprising:

means located at the lower end of said gas generator for restricting the flow of water from said annulus downward into said borehole.

4. The system of claim 2 comprising:

water control means for injecting water into the chamber of said gas generator for cooling purposes.

5. The system of claim 4 wherein said water control means comprises:

water conduit means for flowing water from said borehole into the chamber of said gas generator, and water valve means remotely controllable from the surface located in said borehole near said gas generator for controlling the flow of water through said water conduit means.

6. The system of claim 5, comprising:

means located at the lower end of said gas generator for restricting the flow of water from said annulus downward into said borehole.

7. A system for use for recovering hydrocarbons or other materials from underground formations penetrated by a borehole comprising:

a gas generator located in the borehole at or near the level of said formations, said gas generator comprising: a housing forming a chamber defining a combustion zone and having an upper inlet end for receiving fuel and an oxidizing fluid for forming a combustible mixture of gases in said combustion zone for ignition, and a restricted lower outlet for passage of heated gases, the outer wall of said gas generator being spaced inward from the wall of said borehole defining an annulus for receiving water from said borehole for cooling purposes, means, including conduit means extending from the surface, for supplying fuel from the surface to said inlet end of said gas generator located in said borehole, means, including conduit means extending from the surface, for supplying an oxidizing fluid from the surface to said inlet end of said gas generator located in said borehole, valve means remotely controllable from the surface and located in said borehole near said gas generator for controlling the flow of fuel and oxidizing fluid to said gas generator.

8. The system of claim 7, comprising:

means located at the lower end of said gas generator for restricting the flow of water from said annulus downward into said borehole.

9. The system of claim 8, comprising:

water control means for injecting water into the chamber of said gas generator for cooling purposes.

10. The system of claim 9 wherein said water control means comprises:

water conduit mans for flowing water from said borehole into the chamber of said gas generator, and water valve means remotely controllable from the surface located in said borehole near said gas generator for controlling the flow of water through said water conduit means.

11. The system of claim 10, comprising:

means located at the lower end of said gas generator for restricting the flow of water from said annulus downward into said borehole.

12. A system for use for recovering hydrocarbons or other materials from underground formations penetrated by a borehole, comprising:

a gas generator located in the borehole at or near the level of said formations, said gas generator comprising: a housing forming a chamber defining a combustion zone and having an upper inlet end for receiving fuel and oxidizing fluid for forming a combustible mixture of gases in said combustion zone for ignition, and a restricted lower outlet for passage of heated gases, a source of hydrogen located at the surface, hydrogen conduit means coupled to said source of hydrogen and extending from the surface to said gas generator for supplying hydrogen from the surface to said inlet end of said gas generator located in said borehole, a source of oxygen located at the surface, oxygen conduit means coupled to said source of oxygen and extending from the surface to said gas generator for supplying oxygen from the surface to said inlet end of said gas generator located in said borehole, and means for controlling the flow of hydrogen and oxygen to said gas generator to form a hydrogen-rich combustible mixture in said combustion zone and to maintain the temperature of the gases and fluids flowing through said outlet at a desired temperature level, said hydrogen-rich combustible mixture being defined as having more hydrogen than is needed for complete combustion with the oxygen present.

13. The system of claim 12 wherein:

the outer wall of said gas generator is spaced inward from the wall of said borehole defining an annulus for receiving water from said borehole for cooling purposes.

14. The system of claim 13 comprising:

means located at the lower end of said gas generator for restricting the flow of water from said annulus downward into said borehole.

15. The system of claim 13 comprising:

water control means for injecting water into the chamber of said gas generator for cooling purposes.

16. The system of claim 15 wherein said water control means comprises:

water conduit means for flowing water from said borehole into the chamber of said gas generator, and water valve means controllable from the surface located in said borehole near said gas generator for controlling the flow of water through said water conduit means.

17. The system of claim 16, comprising:

means located at the lower end of said gas generator for restricting the flow of water from said annulus downward into said borehole.

18. A system for use for recovering hydrocarbons or other materials from underground formations penetrated by a borehole comprising:

a gas generator located in the borehole at or near the level of said formations, said gas generator comprising: a housing forming a chamber defining a combustion zone and having an upper inlet end for receiving fuel and an oxidizing fluid for forming a combustible mixture of gases in said combustion zone for ignition, and a restricted lower outlet for passage of heated gases, the outer wall of said gas generator being spaced inward from the wall of said borehole defining an annulus for receiving fluid from said borehole for cooling purposes, structure including a packer located above said chamber, said packer being adapted to be expanded outward against the wall of said borehole to form a seal between said structure and the wall of said borehole, conduit means providing a flow path from a position above said packer to a position below said packer for allowing fluid to flow from said borehole above said packer into said annulus, means, including conduit means extending from the surface, for supplying fuel from the surface to said inlet end of said gas generator located in said borehole, means, including conduit means extending from the surface, for supplying an oxidizing fluid from the surface to said inlet end of said gas generator located in said borehole, valve means remotely controllable from the surface and located in said borehole near said gas generator for controlling the flow of fuel and oxidizing fluid to said gas generator.

19. The system of claim 18, comprising:

means located at the lower end of said gas generator for restricting the flow of fluid from said annulus downward into said borehole.

20. The system of claim 18, comprising:

fluid control means for injecting fluid into the chamber of said gas generator for cooling purposes.

21. The system of claim 20 wherein said fluid control means comprises:

fluid conduit means for flowing fluid from said borehole into the chamber of said gas generator, and fluid valve means remotely controllable from the surface located in said borehole near said gas generator for controlling the flow of fluid through said fluid conduit means.

22. The system of claim 21, comprising:

means located at the lower end of said gas generator for restricting the flow of fluid from said annulus downward into said borehole.

23. The system of claim 18 wherein:

said structure comprises an annular member which extends downward from said packer and surrounds said housing forming said chamber, said annular member being spaced from the wall of said borehole and from said housing forming said chamber defining a first annular space between said annular member and said housing and a second annular space between said annular member and the wall of said borehole, the lower end of said conduit means which provides a flow path from a position above said packer to a position below said packer being in fluid communication with said first annular space, said annular member having passage means formed therethrough for the flow of fluid from said first annular space to said second annular space.

24. The system of claim 23, comprising:

means located at the lower end of said gas generator for restricting the flow of fluid from said second annular space downward into said borehole.

25. A system for use for recovering hydrocarbons or other materials from underground formations penetrated by a borehole, comprising:

a gas generator located in the borehole at or near the level of said formations, said gas generator comprising:

a housing forming a chamber defining a combustion zone and having an upper inlet end for receiving fuel and oxidizing fluid for forming a combustible mixture of gases in said combustion zone for ignition, and a restricted lower outlet for passage of heated gases, the outer wall of said gas generator being spaced inward from the wall of said borehole defining an annulus for receiving fluid from said borehole for cooling purposes, structure including a packer located above said chamber, said packer being adapted to be expanded outward against the wall of said borehole to form a seal between said structure and the wall of said borehole, conduit means providing a flow path from a position above said packer to a position below said packer for allowing fluid to flow from said borehole above said packer into said annulus, a source of hydrogen located at the surface, hydrogen conduit means coupled to said source of hydrogen and extending from the surface to said gas generator for supplying hydrogen from the surface to said inlet end of said gas generator located in said borehole, a source of oxygen at the surface, oxygen conduit means coupled to said source of oxygen and extending from the surface to said gas generator for supplying oxygen from the surface to said inlet end of said gas generator located in said borehole, and means for controlling the flow of hydrogen and oxygen to said gas generator to form a hydrogen-rich conbustible mixture in said combustion zone and to maintain the temperature of the gases and fluids flowing through said outlet at a desired temperature level, said hydrogen-rich combustible mixture being defined as having more hydrogen that is needed for complete combustion with the oxygen present.

26. The system of claim 25 comprising:

means located at the lower end of said gas generator for restricting the flow of fluid from said annulus downward into said borehole.

27. The system of claim 25 comprising:

fluid control means for injecting fluid into the chamber of said gas generator for cooling purposes.

28. The system of claim 27 wherein said fluid control means comprises:

fluid conduit means for flowing fluid from said borehole into the chamber of said gas generator, and fluid valve means controllable from the surface located in said borehole near said gas generator for controlling the flow of fluid through said fluid conduit means.

29. The system of claim 28, comprising:

means located at the lower end of said gas generator for restricting the flow of fluid from said annulus downward into said borehole.

30. The system of claim 25 wherein:

said structure comprises an annular member which extends downward from said packer and surrounds said housing forming said chamber, said annular member being spaced from the wall of said housing forming said chamber defining a first annular space between said annular member and said housing and a second annular space between said annular member and the wall of said borehole, the lower end of said conduit means which provides a flow path from a position above said packer to a position below said packer being in fluid communication with said first annular space, said annular member having passage means formed therethrough for the flow of fluid from said first annular space to said second annular space.

31. The system of claim 30, comprising:

means located at the lower end of said gas generator for restricting the flow of fluid from said second annular space downward into said borehole.

* * * * *